US005997590A

United States Patent [19]

Johnson et al.

[11] Patent Number: 5,997,590

[45] **Date of Patent: *Dec. 7, 1999**

[54] STABILIZED WATER NANOCLUSTER-FUEL EMULSIONS DESIGNED THROUGH QUANTUM CHEMISTRY

[75] Inventors: Keith H. Johnson, Cambridge, Mass.; Bin Zhang, Milpitas, Calif.

[73] Assignee: Quantum Energy Technologies Corp., Woburn, Mass.

[ * ] Notice: This patent is subject to a terminal disclaimer.

[21] Appl. No.: 08/964,249

[22] Filed: Nov. 4, 1997

Related U.S. Application Data

[63] Continuation-in-part of application No. 08/747,862, Nov. 13, 1996, Pat. No. 5,800,576.

[51] Int. Cl.[6] ..... C10L 1/32

[52] U.S. Cl. ..... 44/301; 44/302

[58] Field of Search ..... 44/301, 302

[56] References Cited

U.S. PATENT DOCUMENTS

| | | | |
|---|---|---|---|
| 4,002,435 | 1/1977 | Wenzel et al. | 44/302 |
| 4,355,969 | 10/1982 | Nelson et al. | 431/4 |
| 4,394,131 | 7/1983 | Marro, Jr. et al. | 44/301 |
| 4,477,258 | 10/1984 | Lepain | 44/302 |
| 4,565,548 | 1/1986 | Davis et al. | 44/302 |
| 4,568,354 | 2/1986 | Davis et al. | 44/302 |
| 4,599,088 | 7/1986 | Davis et al. | 44/302 |
| 4,744,796 | 5/1988 | Hazbun et al. | 44/302 |
| 4,770,670 | 9/1988 | Hazbun et al. | 44/301 |
| 4,907,368 | 3/1990 | Mullay et al. | 44/301 |
| 5,004,479 | 4/1991 | Schon et al. | 44/302 |
| 5,051,583 | 9/1991 | Mimura et al. | 250/288 |
| 5,196,129 | 3/1993 | Luisi | 44/301 |
| 5,411,654 | 5/1995 | Ahern et al. | 204/242 |
| 5,478,356 | 12/1995 | Nikanjam et al. | 44/280 |
| 5,503,772 | 4/1996 | Rivas et al. | 44/301 |
| 5,505,876 | 4/1996 | Rivas et al. | 252/311 |
| 5,581,081 | 12/1996 | Kato et al. | 250/288 |
| 5,603,864 | 2/1997 | Silva et al. | 252/311.5 |
| 5,622,920 | 4/1997 | Rivas et al. | 507/232 |
| 5,725,609 | 3/1998 | Rivas et al. | 44/301 |
| 5,800,576 | 9/1998 | Johnson et al. | 44/301 |

FOREIGN PATENT DOCUMENTS

| | | |
|---|---|---|
| 0 339 620 | 11/1990 | European Pat. Off. . |
| 0 475 620 | 3/1992 | European Pat. Off. . |
| 28 14 405 | 10/1979 | Germany . |

OTHER PUBLICATIONS

Ahmed et al., "Vacuum ultraviolet excitation of large water clusters", J. Phys. Chem., vol. 98, pp. 12530–12534 Aug. (1994).

Arnold et al. "Thermal Energy Reactions of Size–Selected Hydrated Electron Clusters $(H_2O)_n$–" J. Phys. Chem., pp. 2900–2906 Jan. (1996).

Cruzan et al., "Quantifying hydrogen bond cooperativity in water: VRT spectroscopy of the water tetramer", J. Phys. Chem., vol. 72, No. 11 (Jun. 1, 1980).

Griffith et al., "Correlating Microemulsioin Fuel Composition, Structure, and Combustion Properties" U.S. Dept. of Energy, Dec. (1989).

(List continued on next page.)

*Primary Examiner*—Ellen M. McAvoy

*Attorney, Agent, or Firm*—Choate, Hall & Stewart; Sam Pasternack; Brenda Herschbach Jarrell

[57] ABSTRACT

The present invention provides combustible compositions utilizing water clusters characterized by high oxygen reactivity due to protruding, delocalized pπ orbitals. In preferred embodiments, the compositions include one or more surfactants having molecular orbitals that interact with and participate in the delocalized pπ orbitals. The invention also provides methods of designing, producing, and using the compositions.

45 Claims, 29 Drawing Sheets

OTHER PUBLICATIONS

Holland et al., "A model for the formation and stabilization of charged water clathrates", J. Chem. Phys., p. 72(11) (Jun. 1, 1980).

Johnson et al., "Molecular Orbital Basis for Superconductivity with Applications To High–$T_c$ Materials", Novel Superconductivity, pp. 563–576 (1987).

Kassner et al., "Comment on clustering of water on hydrated protons in a supersonic free jet expansion", J. Phys. Chem., vol. 64, No. 4, (Feb. 15, 1976).

Laasonen et al., "Structural study of $(H_2O)_{20}$ and $(H_2O)_{21}H^+$ using density functional methods", J. Phys. Chem., vol. 98, pp. 10079–10083 (1994).

Liu et al., "Characterization of a cage form of the water hexamer", Nature, vol. 381, (Jun. 6, 1996).

Liu et al., "Vibration–Rotation Tunneling Spectra of the Water Pentamer: Structure and Dynamics", Science, vol. 271, pp. 62–64 (Jan. 5, 1996).

Melius, et al., "Effects of Water on Combustion Kinetics At High Pressure", The Combustion Institute, pp. 217–223 (1990).

Rousset et al., "Dynamical structure of water:low–frequency Raman scattering from a disordered network and aggregates", J. Chem. Phys., vol. 92, No. 4 (Feb. 15, 1990).

Schindler et al., "Protonated water clusters and their black body radiation induced fragmentation", Chemical Physics Letter, 250, pp. 301–308 Mar. (1996).

Sette et al., "Collective dynamics in water by high energy resolution inelastic X–ray scattering", vol. 75, No. 5 (Jul. 31, 1995).

Sokolov et al., "Dynamics of supercooled water: mode–coupling theory approach", Physical Review, vol. 51, No. 18 (May 1, 1995).

Thrane et al., "THz reflection spectroscopy of liquid water", Chem. Phys. Letters, 240, pp. 330–333 Mar. (1995).

Wei et al., Mixed cluster ions as a structure probe: experimental evidence for clathrate structure of $(H_2O)_{20}H^+$and $(H_2O)_{21}H^+$, J. Chem. Phys., 94(4) (Feb. 15, 1991).

Yang et al., "Large protonated water clusters H+$(H_2O)$n ($1 \leq n > 60$): the production and reactivity of clathrate–like structures under thermal conditions", J. Am. Chem. Soc., 111, 6485–6846 Apr. (1989).

Zhang et al., "Evidence for the formation of clathrate structures of protonated water–methanol clusters at thermal energy", J. Chem. Phys., vol. 101, No. 2 (Jul. 15, 1994).

"Water tetramers and pentamers observed", C&EN, p. 7 (Jan. 8, 1996).

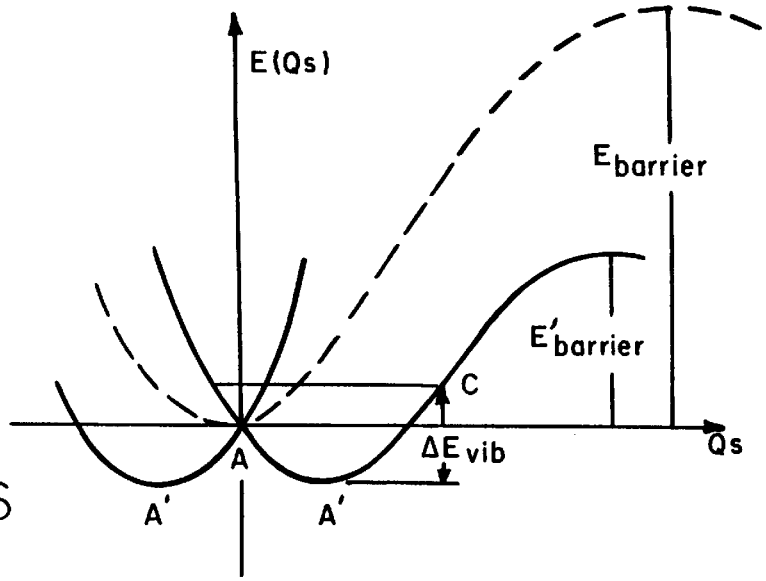
FIG. 6
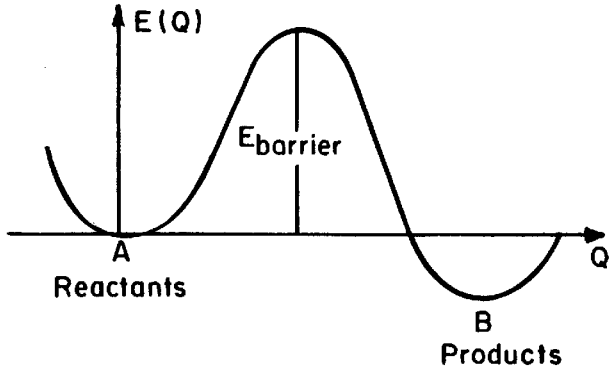
FIG. 7
FIG. 8
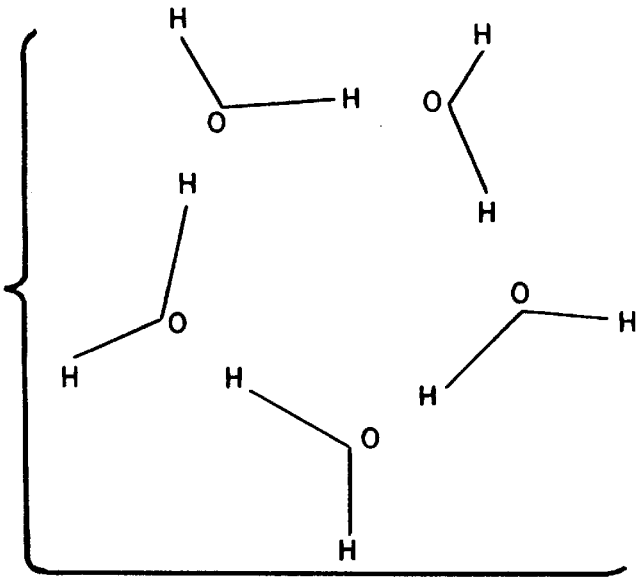

STABILIZED WATER NANOCLUSTER-FUEL EMULSIONS DESIGNED THROUGH QUANTUM CHEMISTRY

The present application is a Continuation-in-part of co-pending application Ser. No. 08/747,862, filed Nov. 3, 1996, now U.S. Pat. No. 5,800,576, the entire contents of which are incorporated herein by reference.

BACKGROUND OF THE INVENTION

Due to its critical importance in processes ranging from heat transfer to solvation and biological reactions, water has been extensively studied. However, the microscopic structure of water is still poorly understood. Only recently have systematic studies been undertaken to evaluate complex water structures (see, for example, Pugliano et al., *Science* 257:1937, 1992). None of the studies performed to date, all of which focus on hydrogen bonding capabilities, has provided a full picture of the structure and properties of water. Accordingly, there remains a need for development of a more accurate understanding of water structure and characteristics. Moreover, mechanisms for harnessing water's extraordinary properties for practical applications are required.

One particular application for which water use has been explored is in the area of fuel combustion. In the past, water has been dispersed in fuels in order to i) decrease fuel flammability; ii) decrease the temperature of combustion; iii) reduce particulate emissions resulting from combustion; and/or iv) reduce levels of NOx emissions resulting from combustion (see, for example Donnelly et al., DOE/CS/50286-4, published September 1985; Compere et al., ORNL TM-9603, published March 1985 by A. L. Compere et al.; Griffith et al., U.S. DOE ORNL TM-11248 DE89 017779). However, no stable, combustible water/fuel dispersion has made it to market. Several problems that have been encountered in the preparation of such compositions. There remains a need for a stable, inexpensive water/fuel composition that has improved combustion properties.

SUMMARY OF THE INVENTION

The present invention provides an analysis of water structure that reveals unexpected characteristics of certain molecular arrangements. While most prior investigations have focused on the role of hydrogen bonding in water, the present invention encompasses the discovery that second-nearest neighbor interactions between oxygen atoms in adjacent water molecules help determine the long-range properties of water.

The present invention provides the discovery that oxygens on neighboring water molecules can interact with one another through overlap of oxygen p orbitals. This overlap produces degenerate, delocalized pπ orbitals that mediate long-range interactions among water molecules in liquid water. The present invention provides the further discovery that, in clusters of small numbers of water molecules, interactions among the water molecules can produce structures in which these degenerate, delocalized orbitals protrude from the structure surface in a manner that renders them available for reaction with other atoms or molecules. The invention therefore provides water clusters containing reactive oxygens. These oxygens can contribute to fuel combustion.

Preferred water clusters of the present invention have high symmetry, preferably at least pentagonal symmetry. Also, it is preferred that oxygen-oxygen vibrational modes in the clusters are induced, either through application of an external electromagnetic or accoustical field or through intrinsic action of the dynamical Jahn-Teller (DJT) effect. As is known, the Jahn-Teller (JT) effect causes highly symmetrical structures to distort or deform along symmetry-determined vibronic coordinates (Bersuker et al., "Vibronic Interactions in Molecules and Crystals" Springer-Verlag, 1989). Potential energy minima corresponding to the broken-symmetry forms then arise, and the structure can either settle into one of these minima (static Jahn-Teller effect) or can oscillate between or among such minima by vibrating along the relevant vibrational coordinates (dynamical Jahn-Teller effect).

The present invention provides the recognition that DJT-induced vibronic oscillations in certain water clusters can significantly lower the energy barrier for chemical reactions involving such clusters. Specifically, the present invention teaches that water clusters (or aggregates thereof) having a ground-state electronic structure characterized by a manifold of fully occupied molecular orbitals (HOMO) separated from a manifold of unoccupied molecular orbitals (LUMO) by an energy gap can be made to have enhanced reactivity characteristics if a degeneracy (or near degeneracy) is induced between the HOMO and LUMO states, leading to a prescribed distortive symmetry breaking and DJT-induced vibronic oscillations.

In one particular embodiment, the present invention provides useful compositions including these reactive water clusters. Preferred compositions of the present invention are combustible compositions in which the water clusters are dispersed in, for example, a fuel. Certain preferred combustible compositions involve water clusters dispersed within a fuel and stabilized by one or more surfactants selected for an ability to contribute to the desirable electronic structure of the water cluster. Preferred surfactants donate one or more electrons to the delocalized pπ orbitals. In most cases, these preferred surfactants will be oxygen-rich compounds. Particularly preferred surfactants additionally have one or more of the following characteristics: i) they have appropriate density and miscibility attributes so that they mix readily with the water and fuel and the water/fuel/surfactant emulsion is stable for more than about one year; ii) they introduce no new toxicities into the composition (or into the environment upon combustion of the composition); and iii) they are inexpensive. The invention further provides methods of designing, making, and using such combustible compositions.

DESCRIPTION OF THE DRAWINGS

FIG. 2 depicts the preferred relative orientation of adjacent water molecules.

FIG. 5 shows various characteristics of pentagonal dodecahedral water structures.

vibrational modes associated with oxygen-oxygen interactions in the structures.

FIG. 6 shows potential energy wells for Jahn-Teller disterted water clusters and the resulting reduction in the energy barrier for reaction of these water clusters.

FIG. 7 shows a reaction path for A→B.

FIG. 8 depicts a pentagonal, 5-molecule water cluster.

Figure 9:
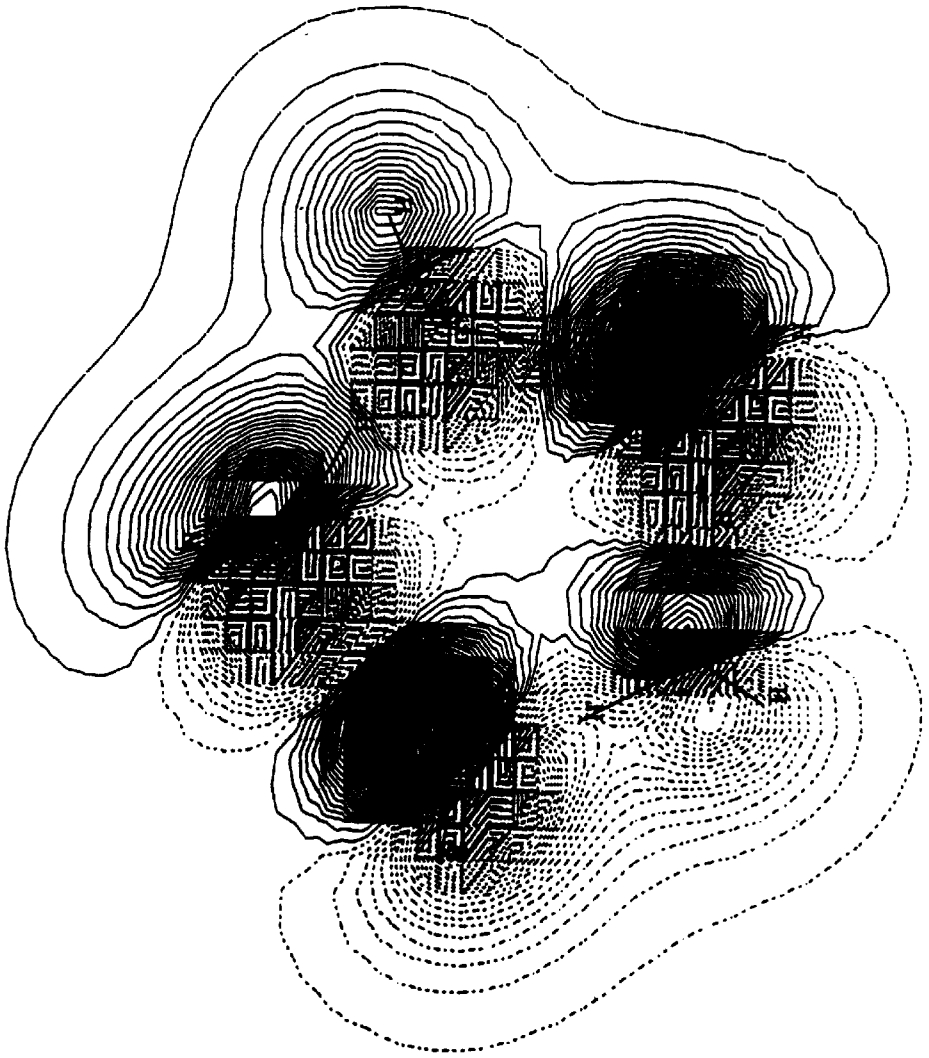

FIG. 9 shows one of the delocalized pπ orbitals of the 5-molecule water cluster shown in FIG. 8.

Figure 10:
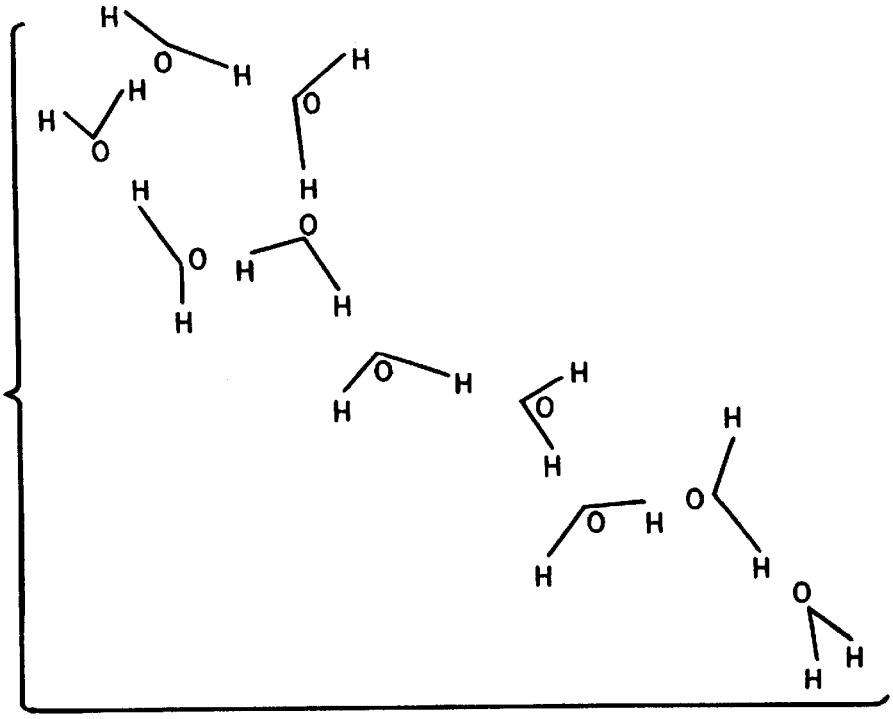

FIG. 10 depicts a 10-molecule water cluster having partial pentagonal symmetry.

Figure 11:
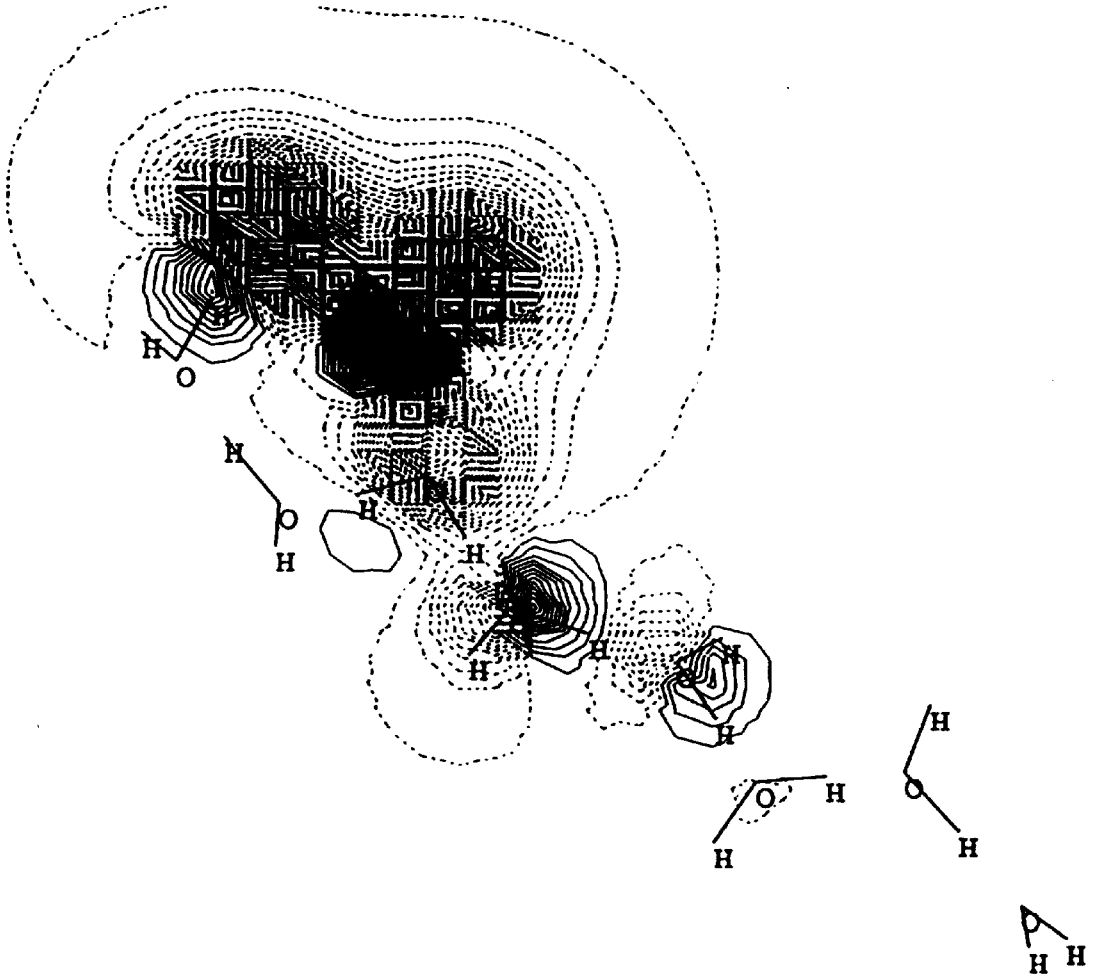
Figure 13A:
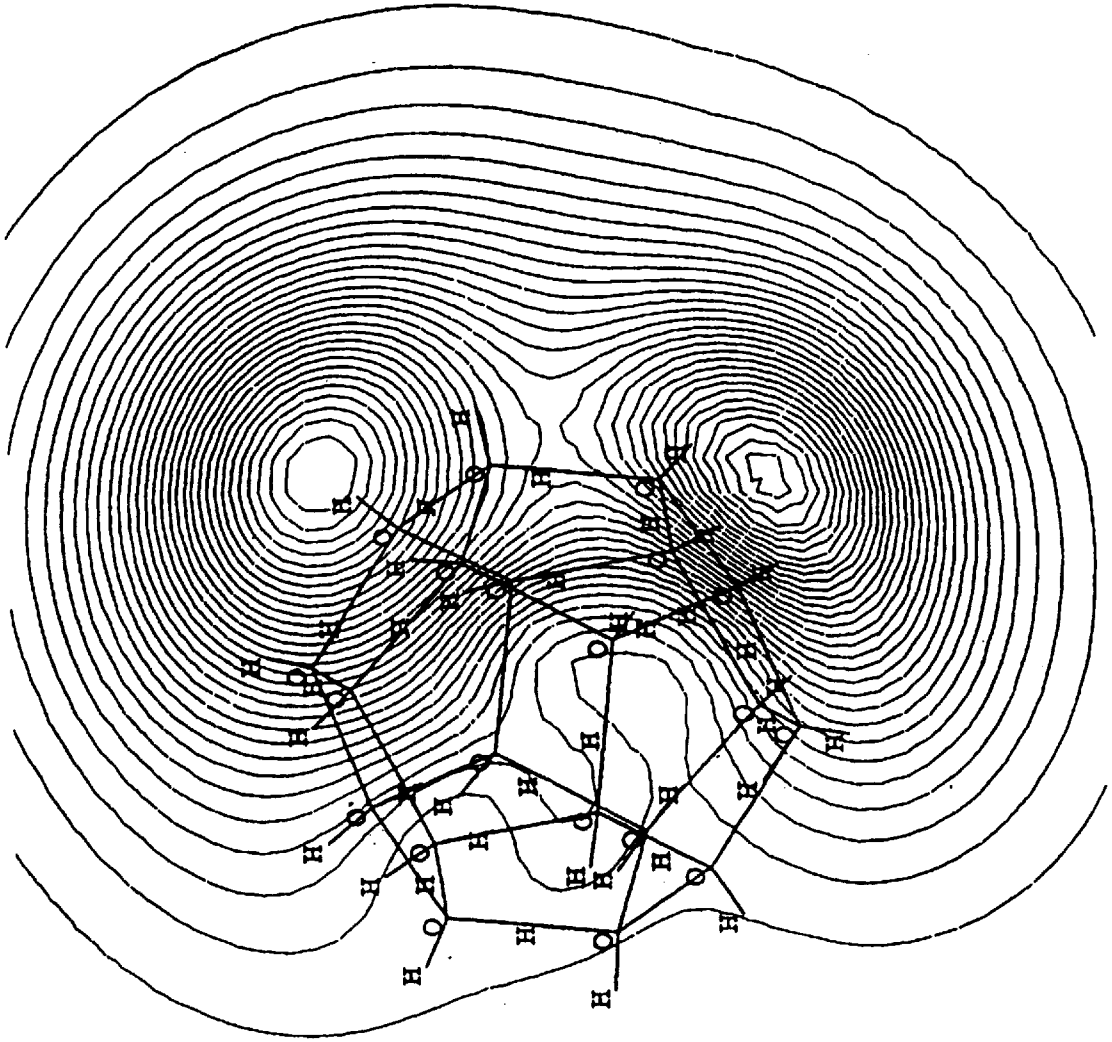
Figure 13B:
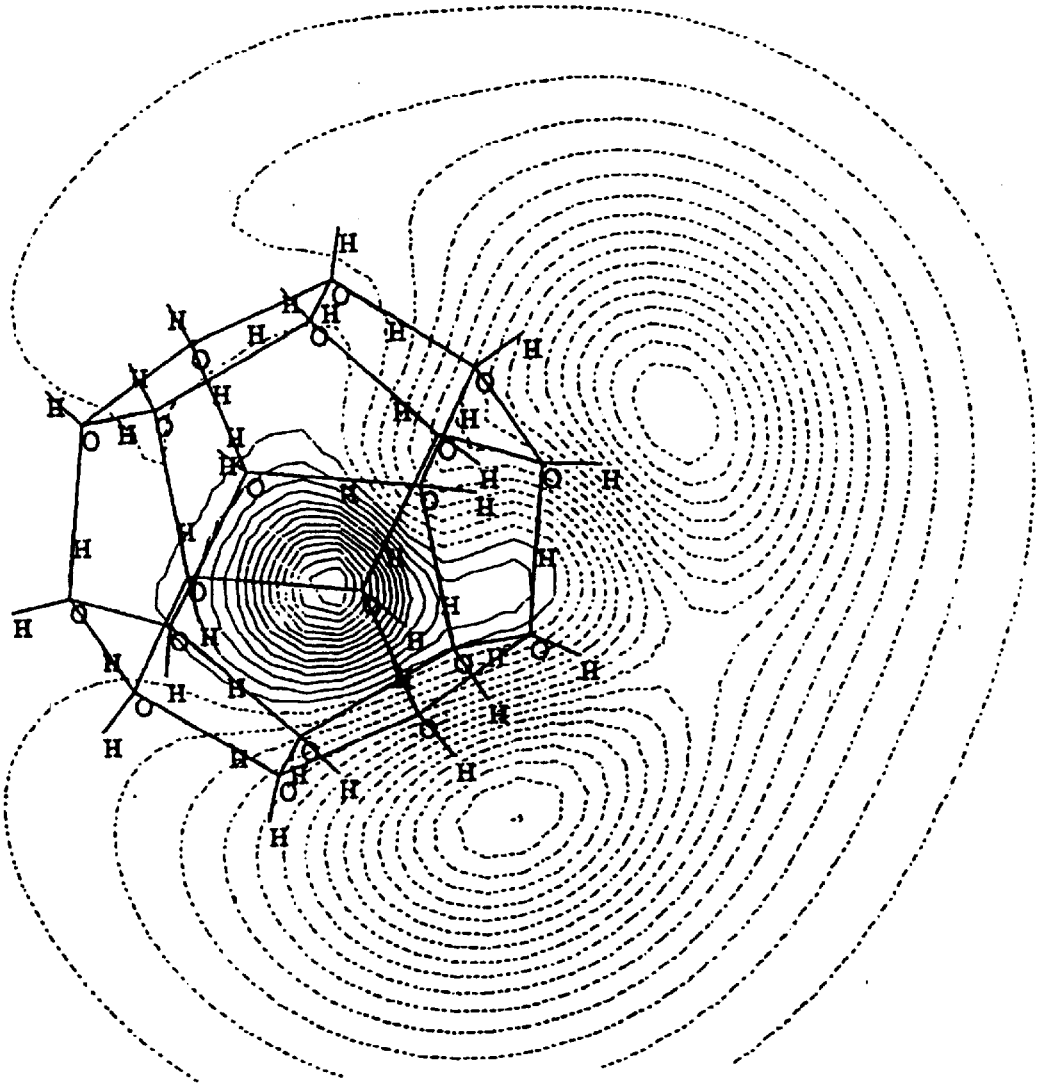
Figure 13C:
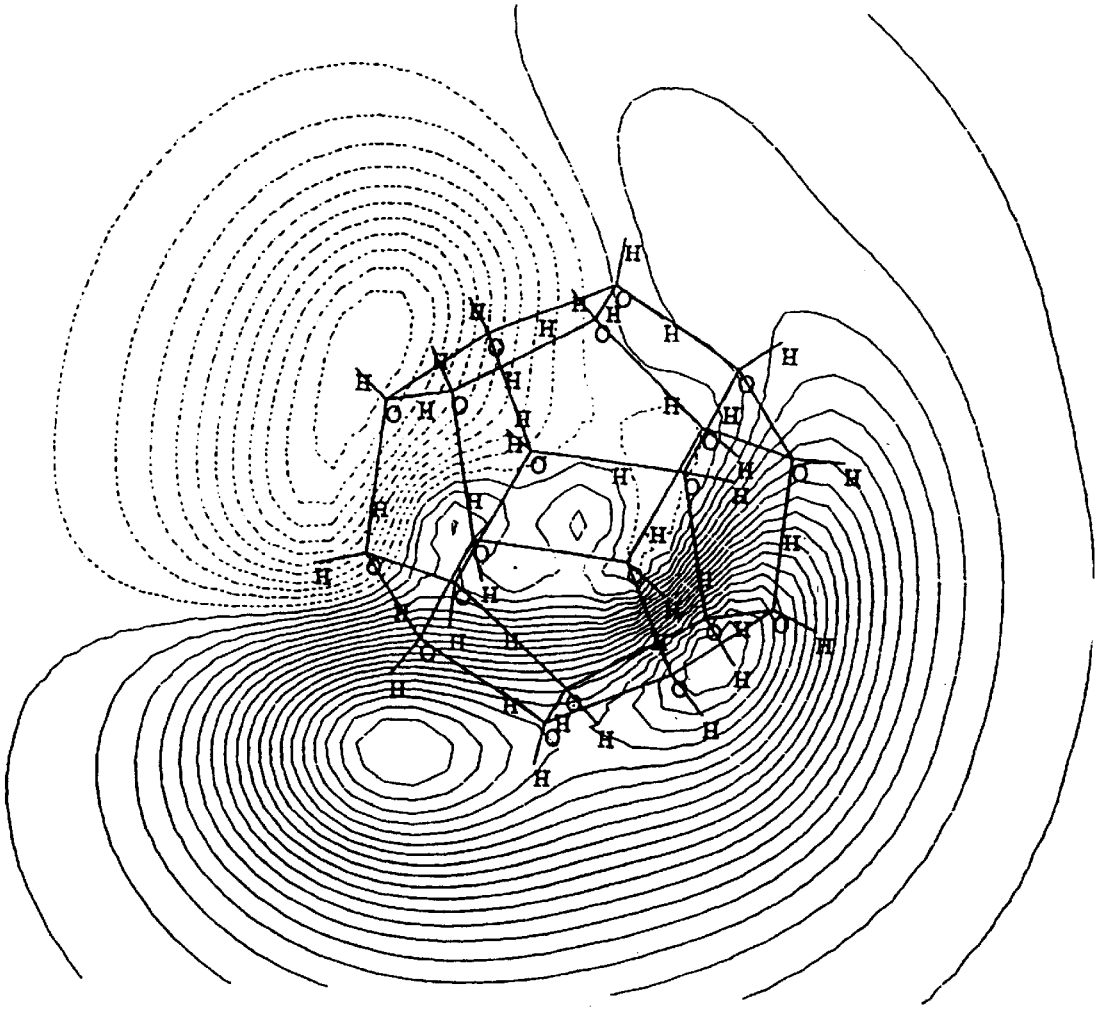
Figure 13D:
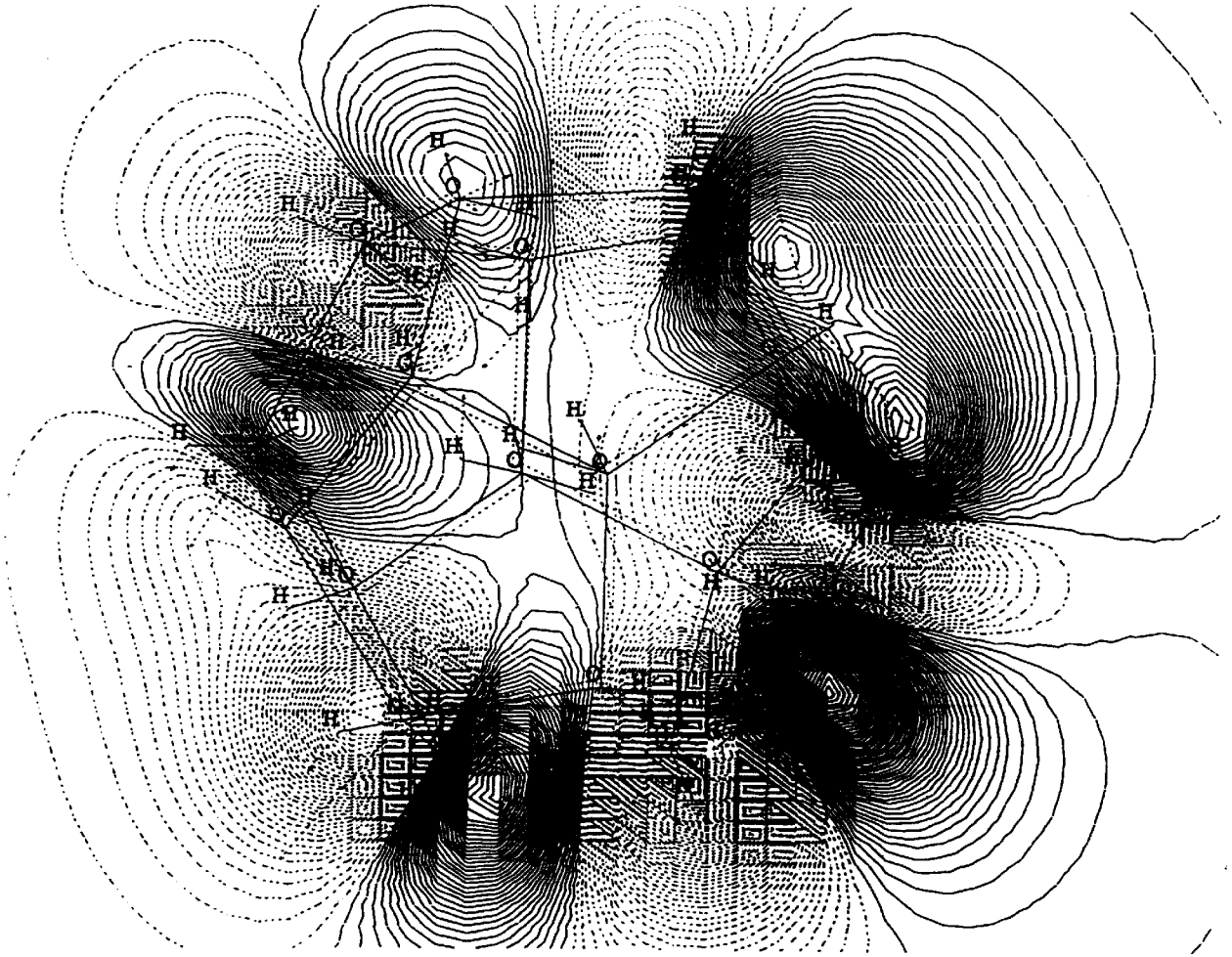
Figure 13E:
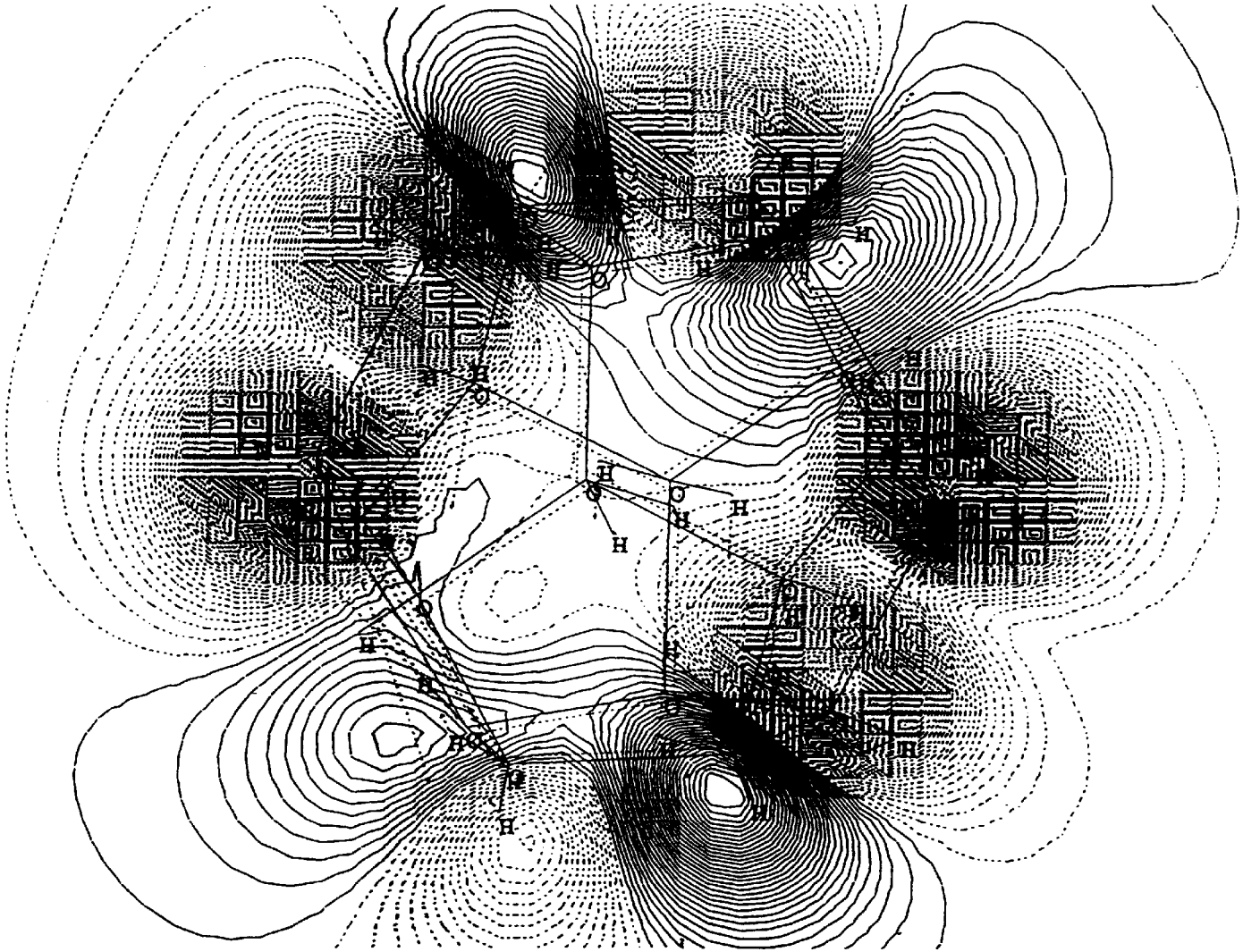

FIG. 11 shows one of the delocalized pπ orbitals of the 10-molecule water cluster shown in FIG. 10.

Figure 12:
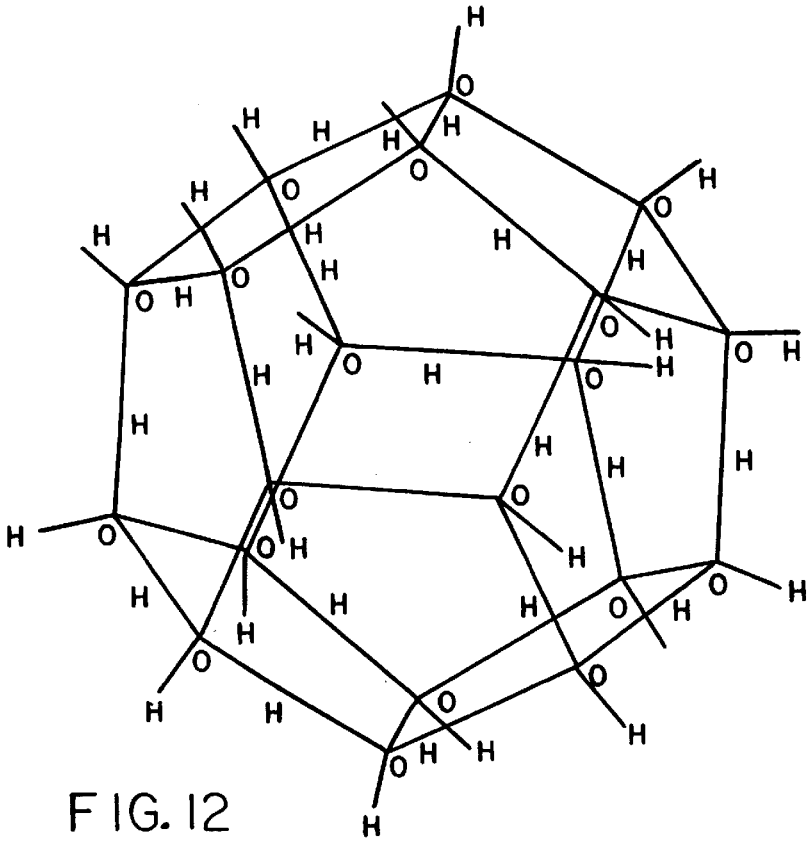

FIG. 12 shows a 20-molecule pentagonal dodecahedral water cluster.

FIG. 13, Panels A–E, show different delocalized pπ orbitals associated with the 20-molecule pentagonal dodecahedral water cluster of FIG. 12.

Figure 14:
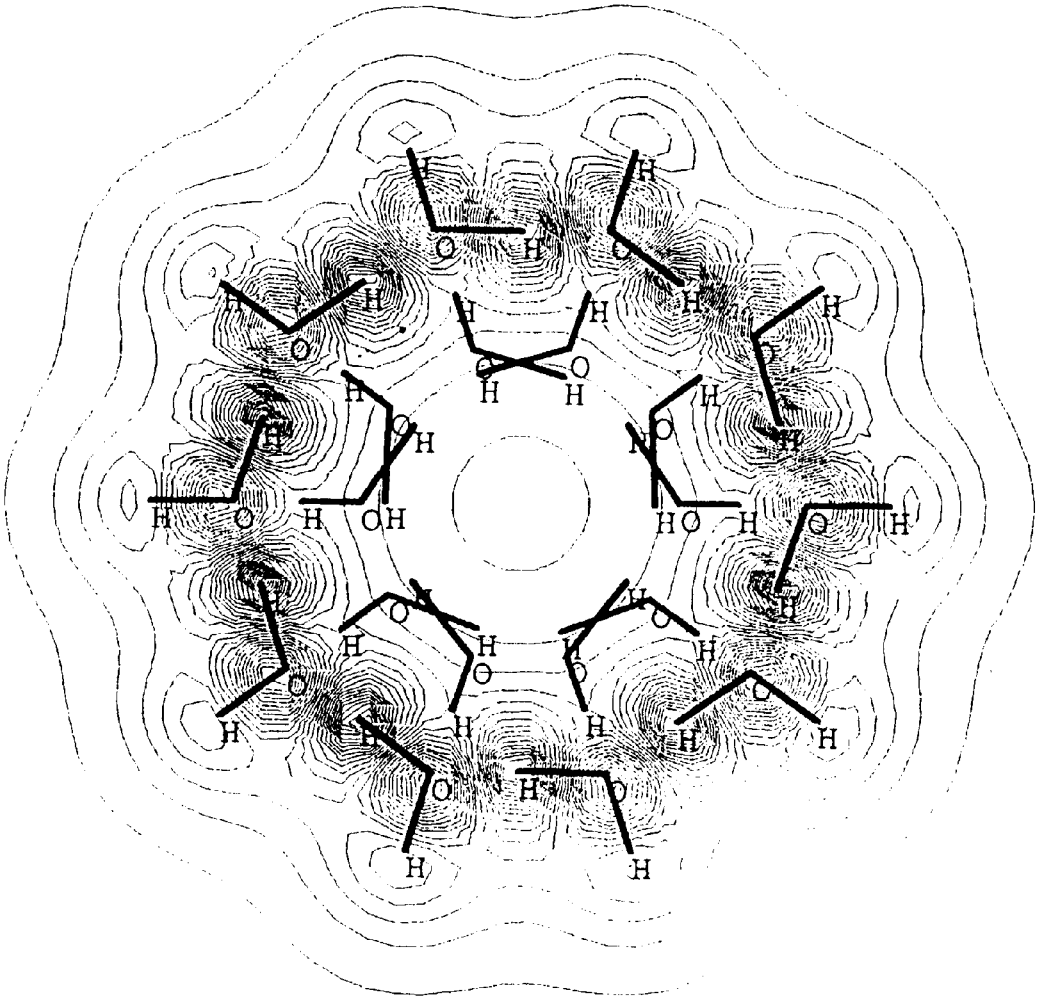

FIG. 14 shows an s-like LUMO molecular orbital of a pentagonal dodecahedral water cluster.

Figure 15:
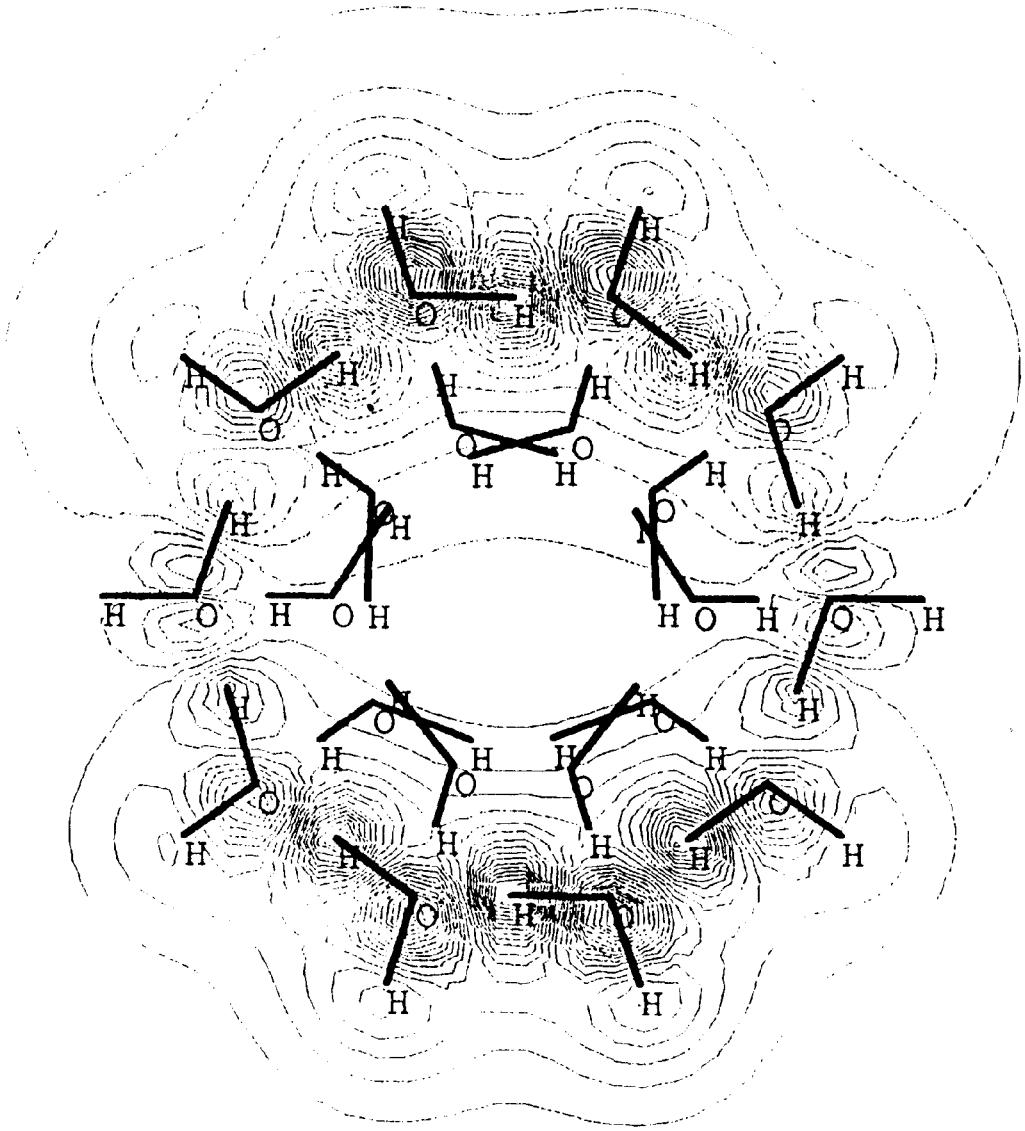

FIG. 15 shows a p-like LUMO molecular orbital of a pentagonal dodecahedral water cluster.

Figure 16:
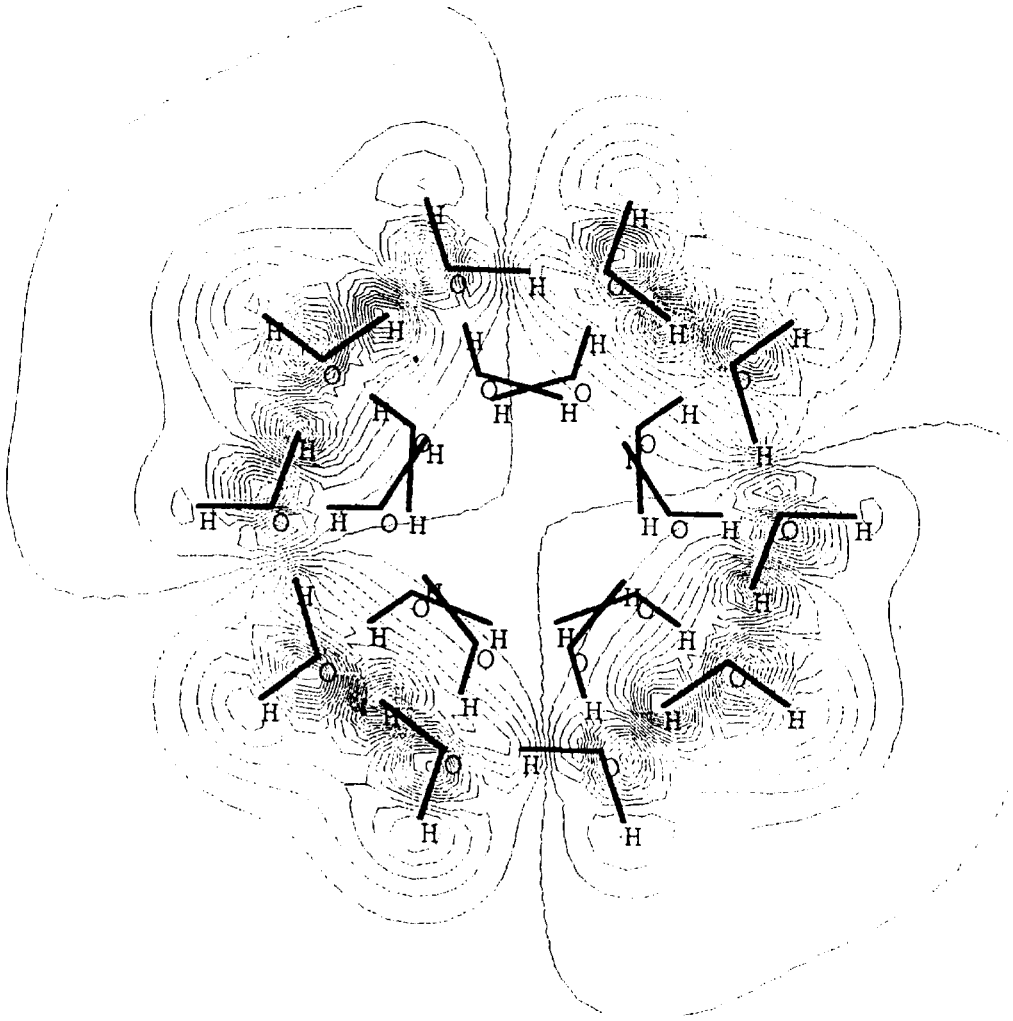

FIG. 16 shows a d-like LUMO molecular orbital of a pentagonal dodecahedral water cluster.

Figure 17:
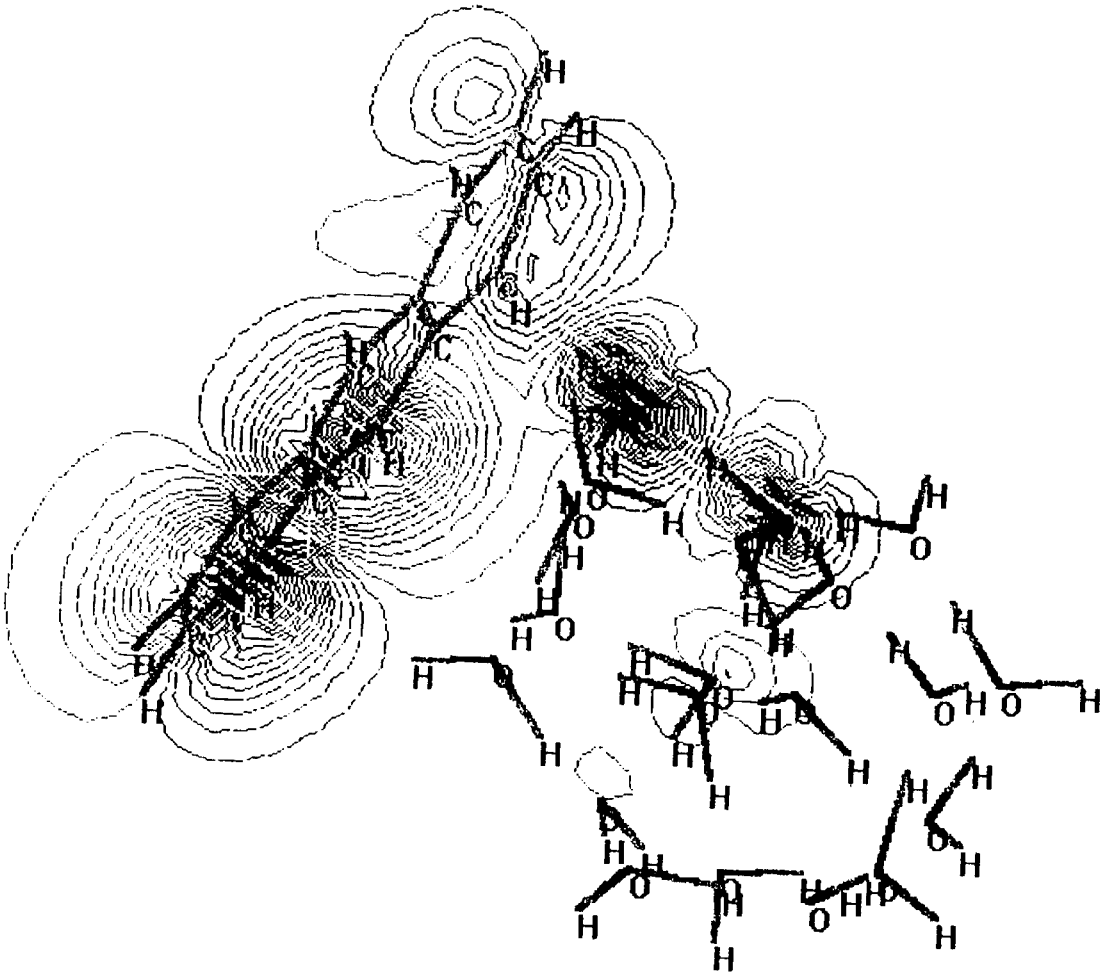

FIG. 17 shows the interaction of water cluster pπ orbitals with the carbon pπ orbitals of an aromatic soot precursor.

Figure 18:
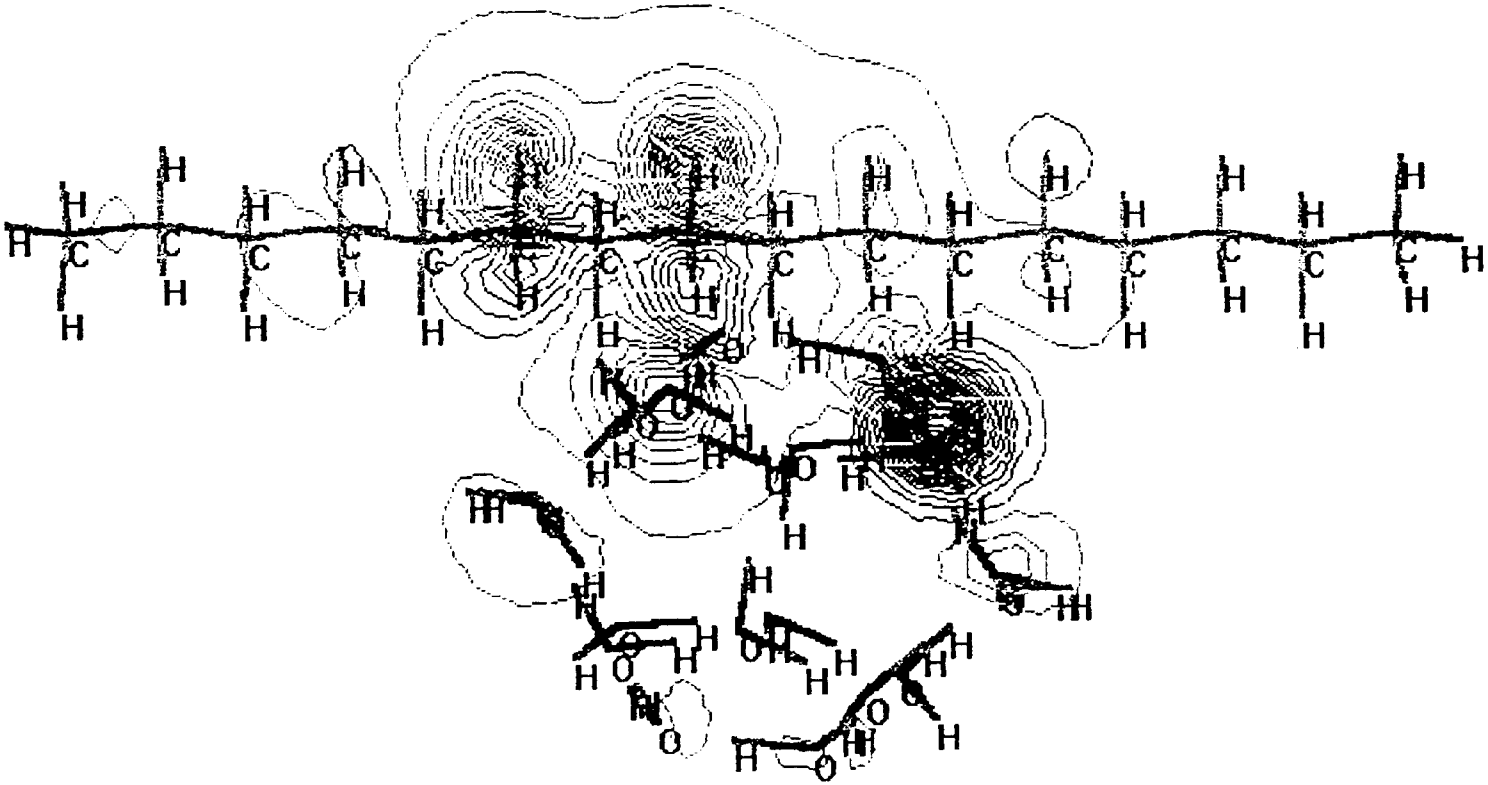

FIG. 18 shows the interaction of water cluster pπ orbitals with the carbon pπ orbitals of a cetane (diesel) fuel molecule.

Figure 19:
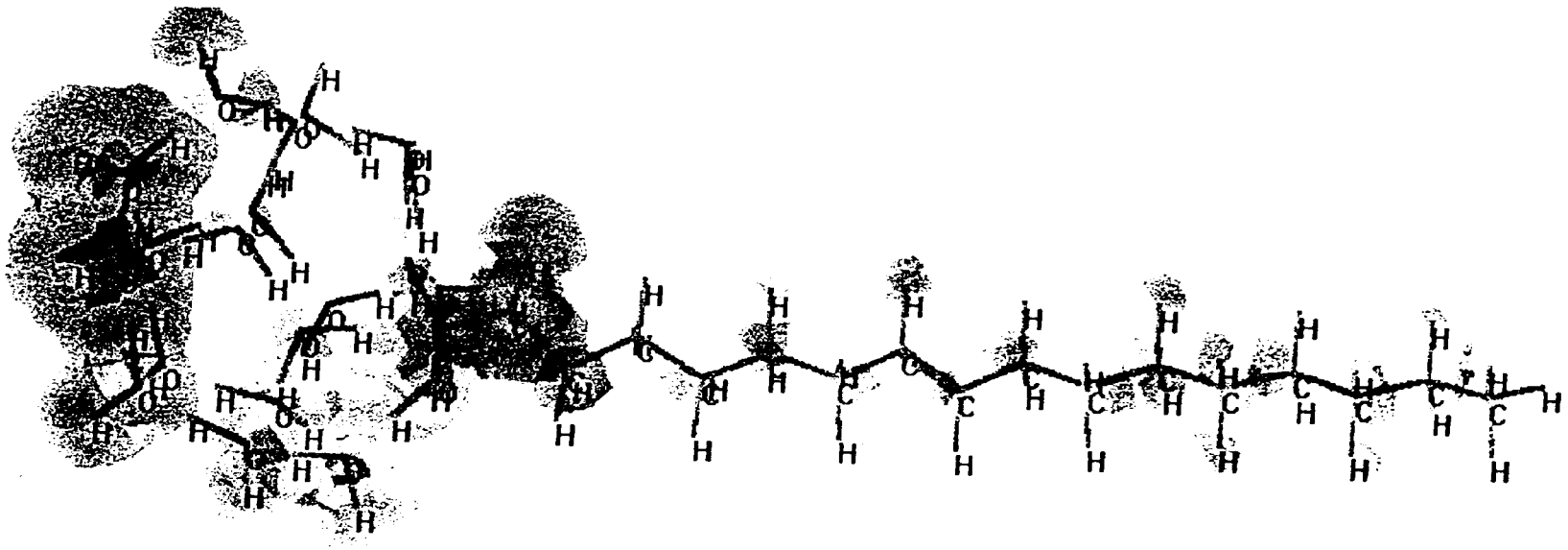

FIG. 19 shows a water cluster interacting with a typical fatty acid surfactant by sharing molecular orbitals.

Figure 20:
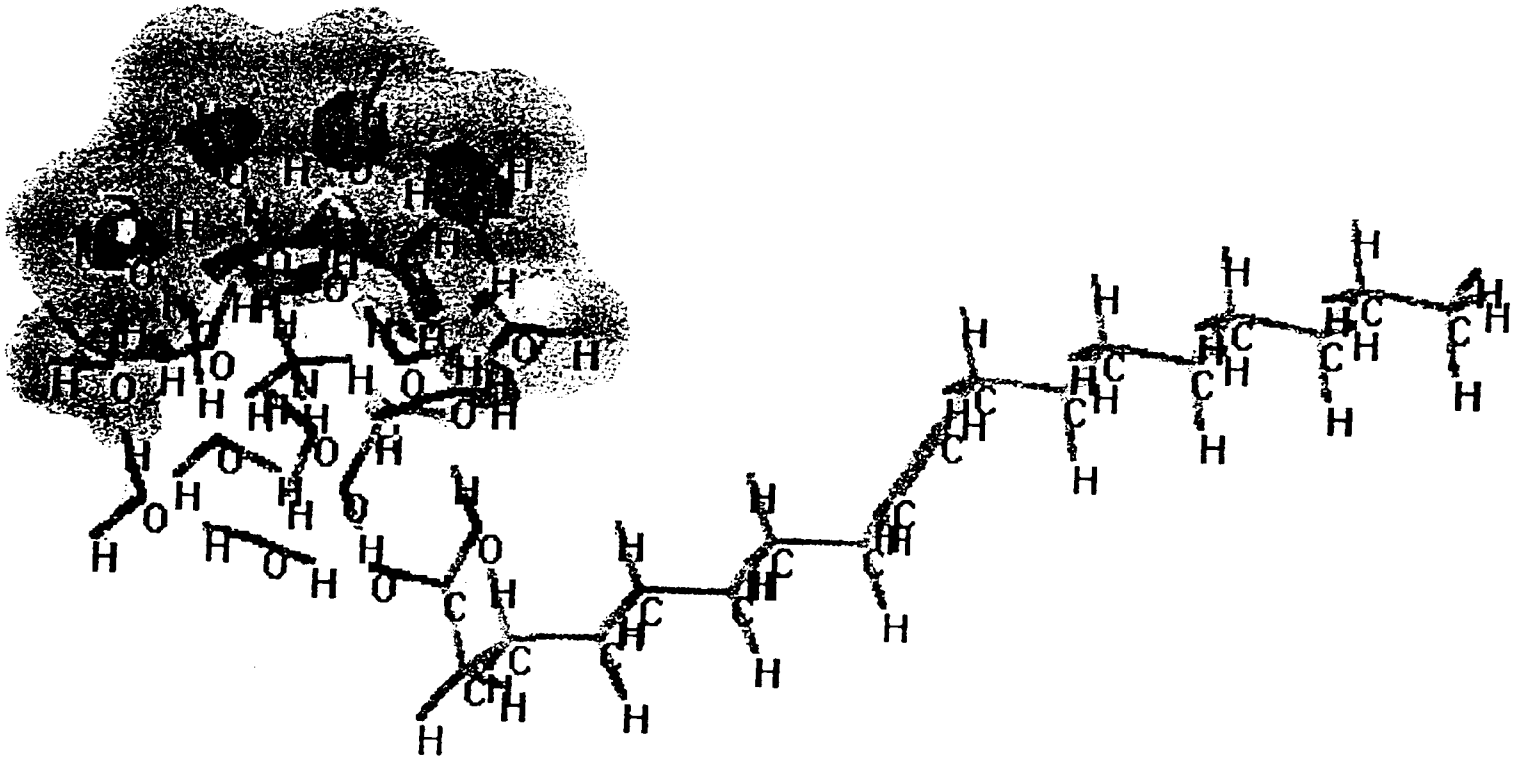

FIG. 20 shows the effect of including neutralizing agent in the water cluster/surfactant system shown in FIG. 19.

Figure 21:
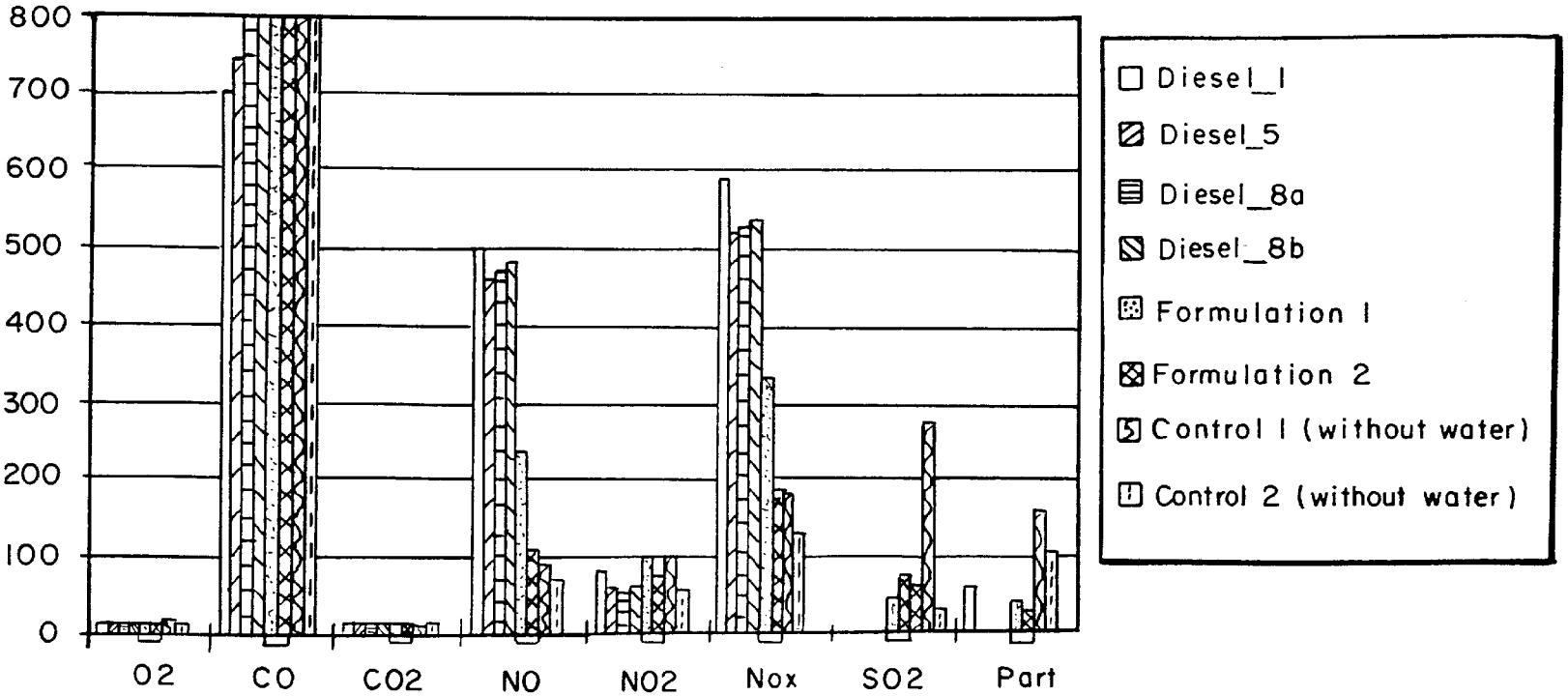

FIG. 21 presents emission data from combustion of water cluster/fuel emulsions of the present invention.

Figure 22:
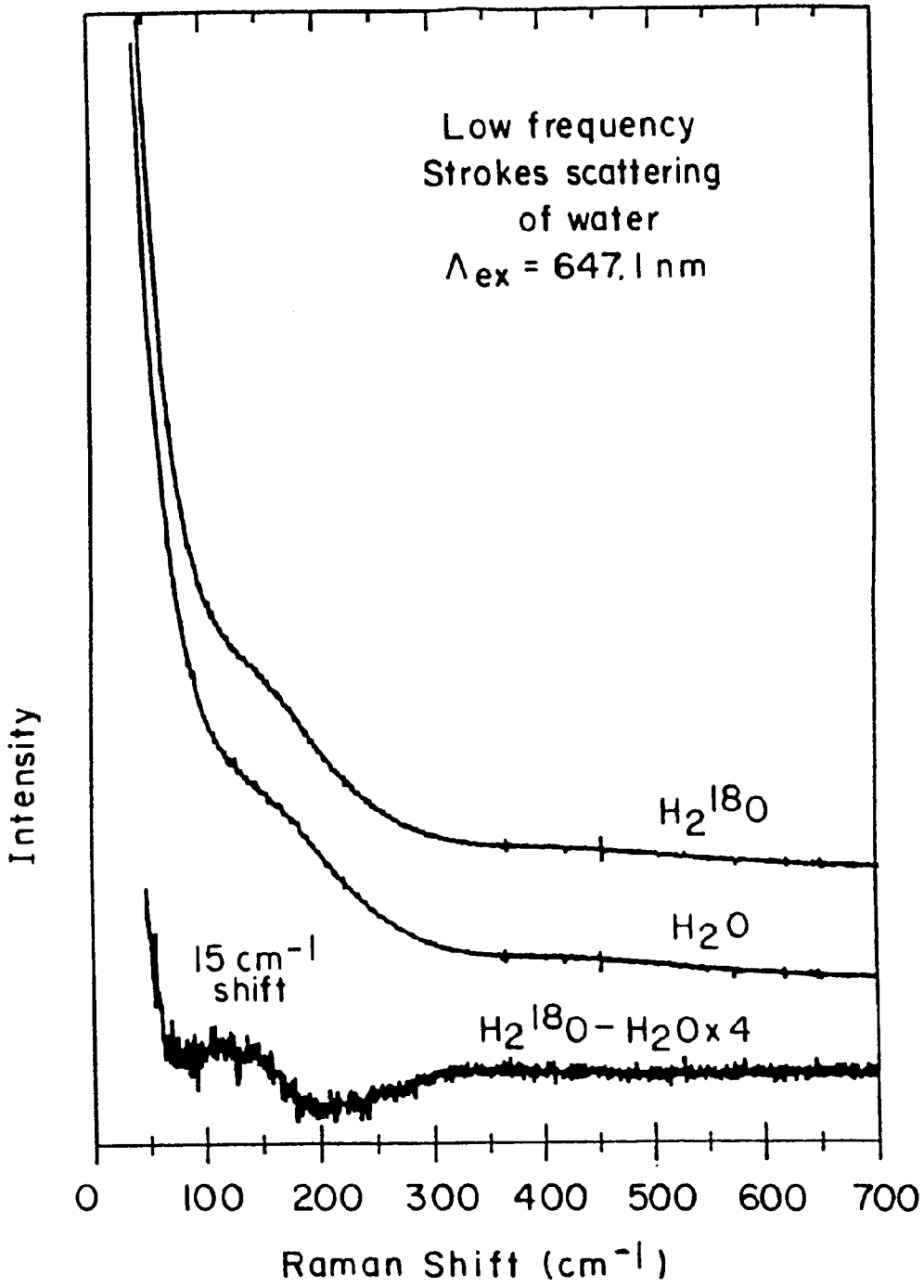

FIG. 22 presents an $H_2O/H_2O^{18}$ difference Raman spectrum for a water cluster/fuel emulsion of the present invention.

Figure 23:
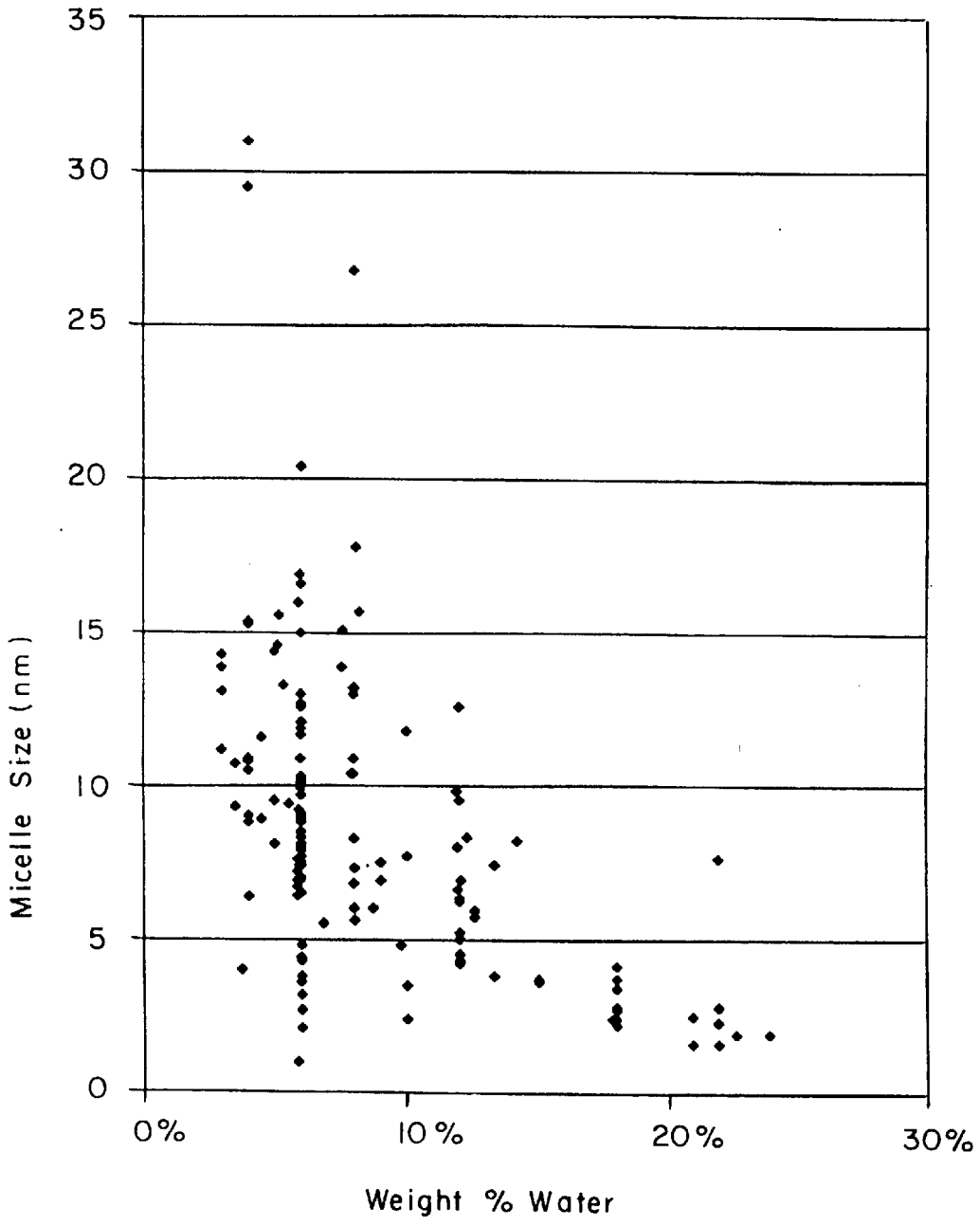

FIG. 23 shows that decreasing micelle size correlates with increasing weight percent of water.

Figure 24:
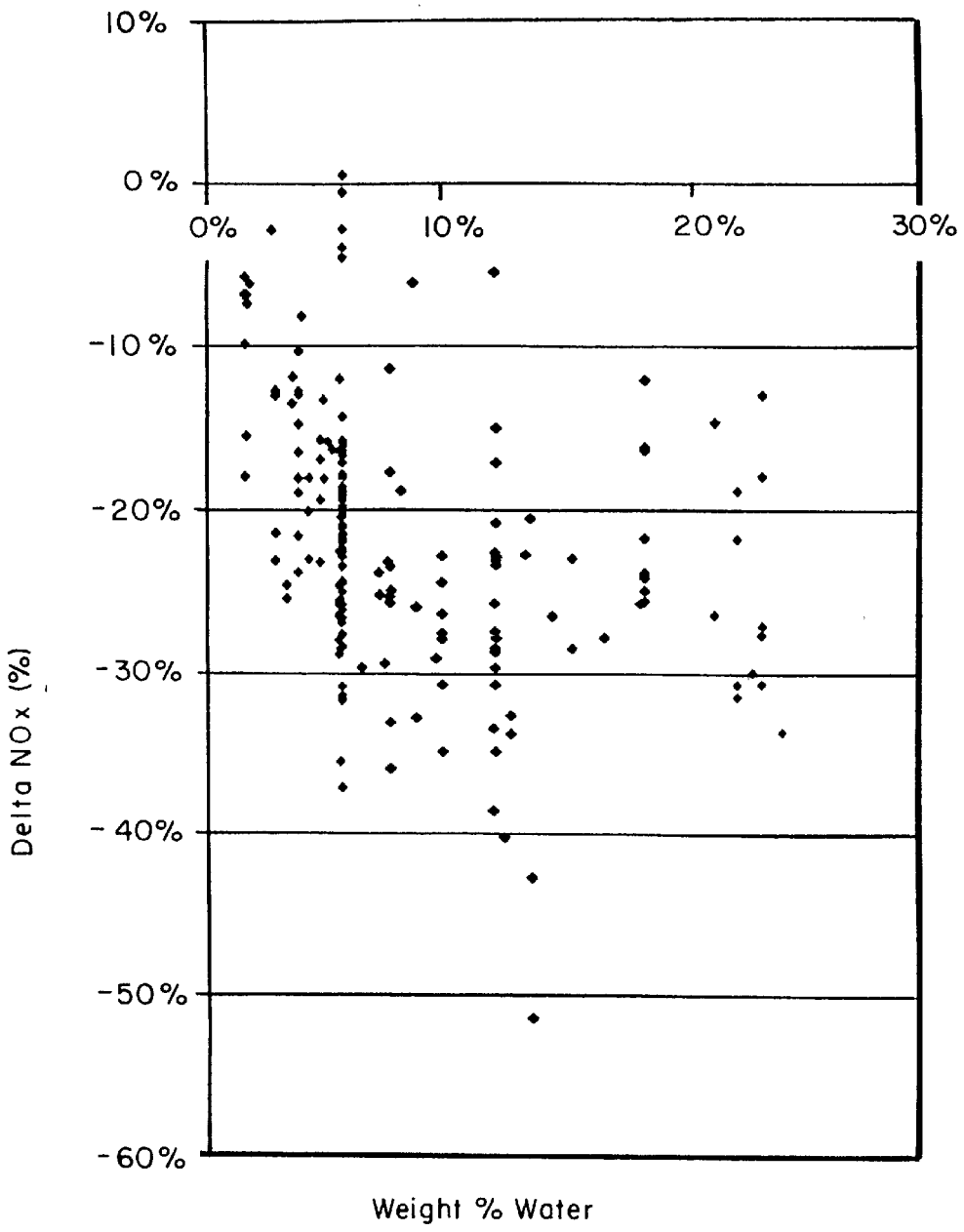

FIG. 24 shows that increasing wieght percent water (which correlates with decreasing micelle size) correlates with decreasing NOx emissions.

Figure 25:
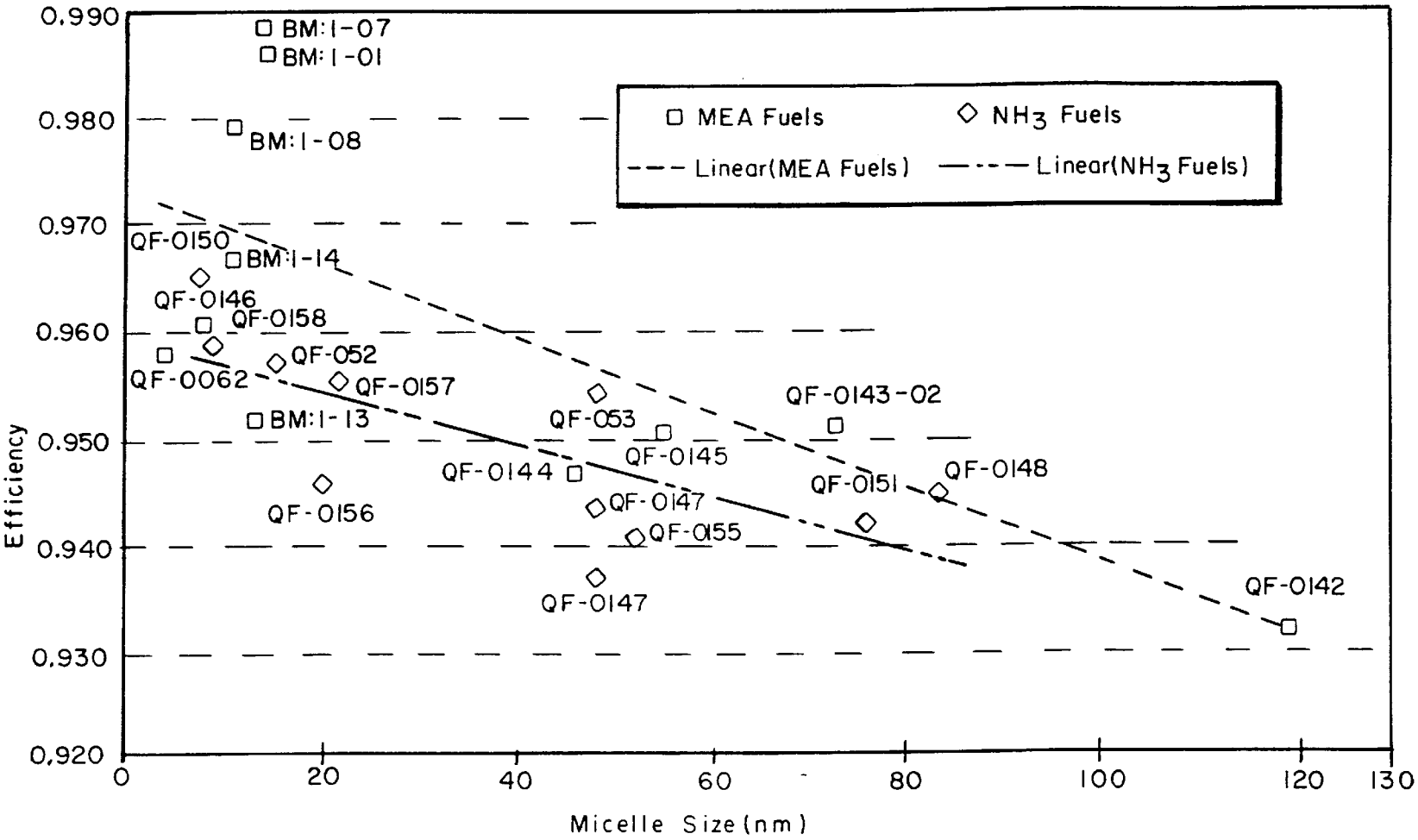

FIG. 25 shows that decreasing micelle size correlates with increasing combustion efficiency.

Figure 26A:
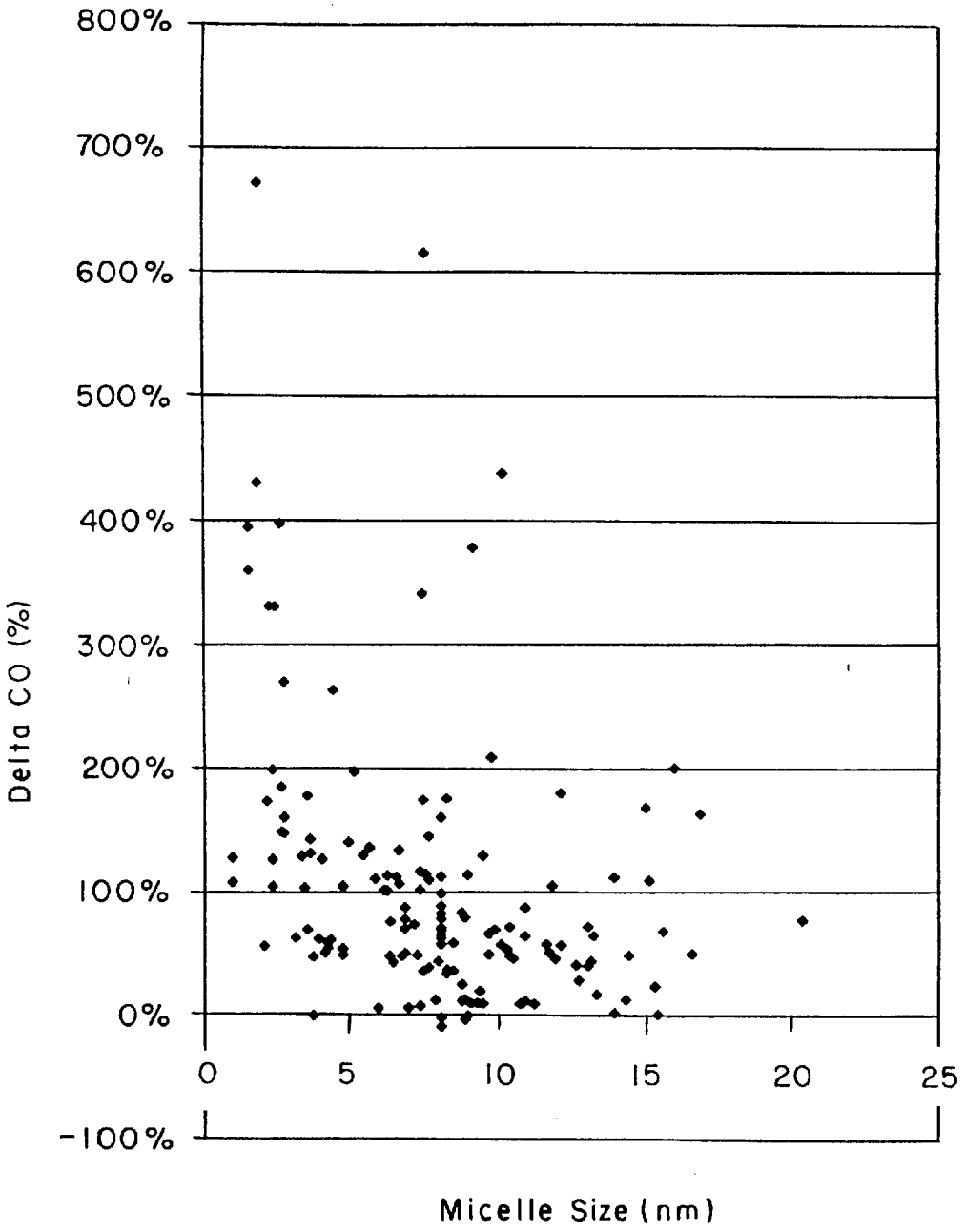
Figure 26B:
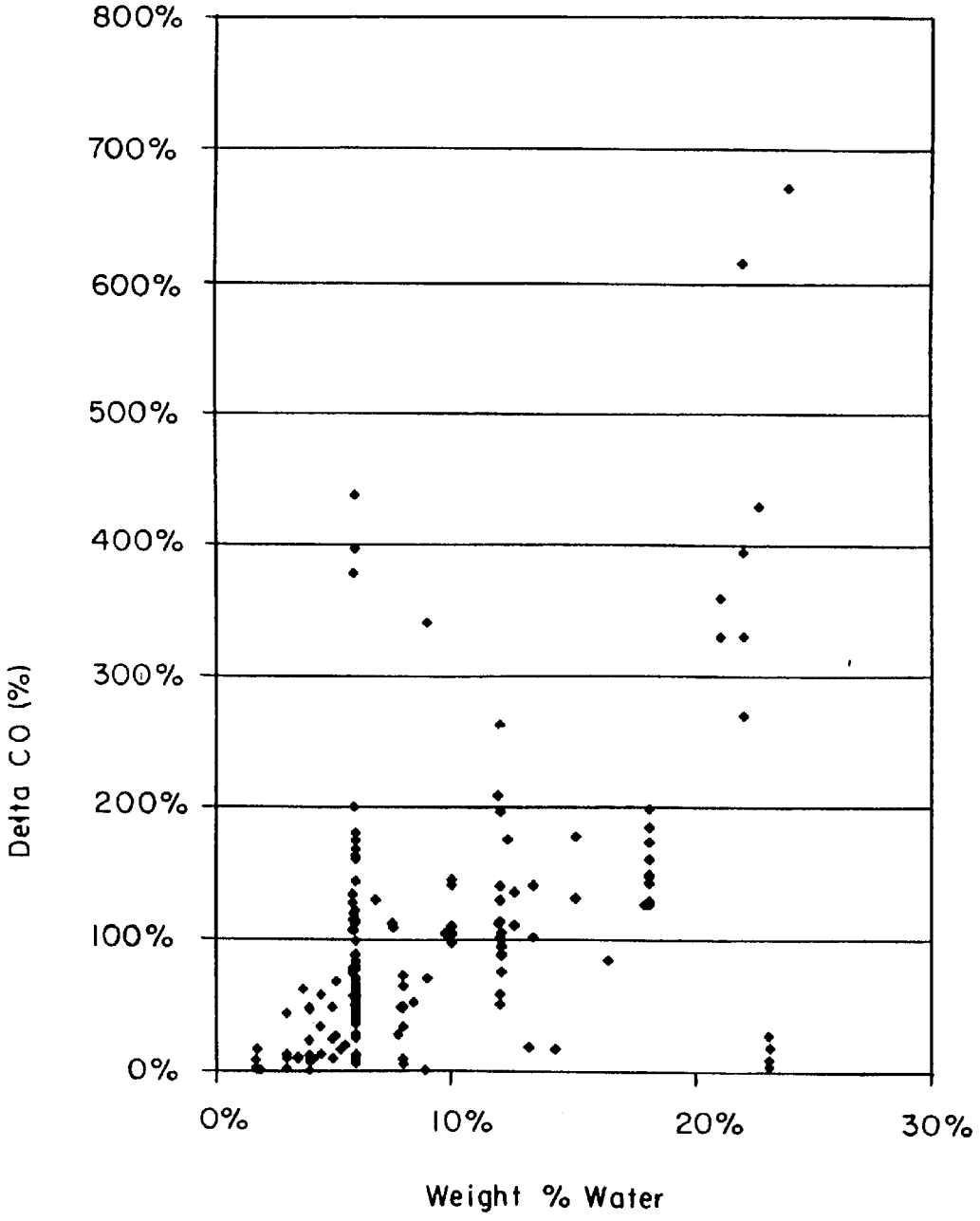
Figure 26C:
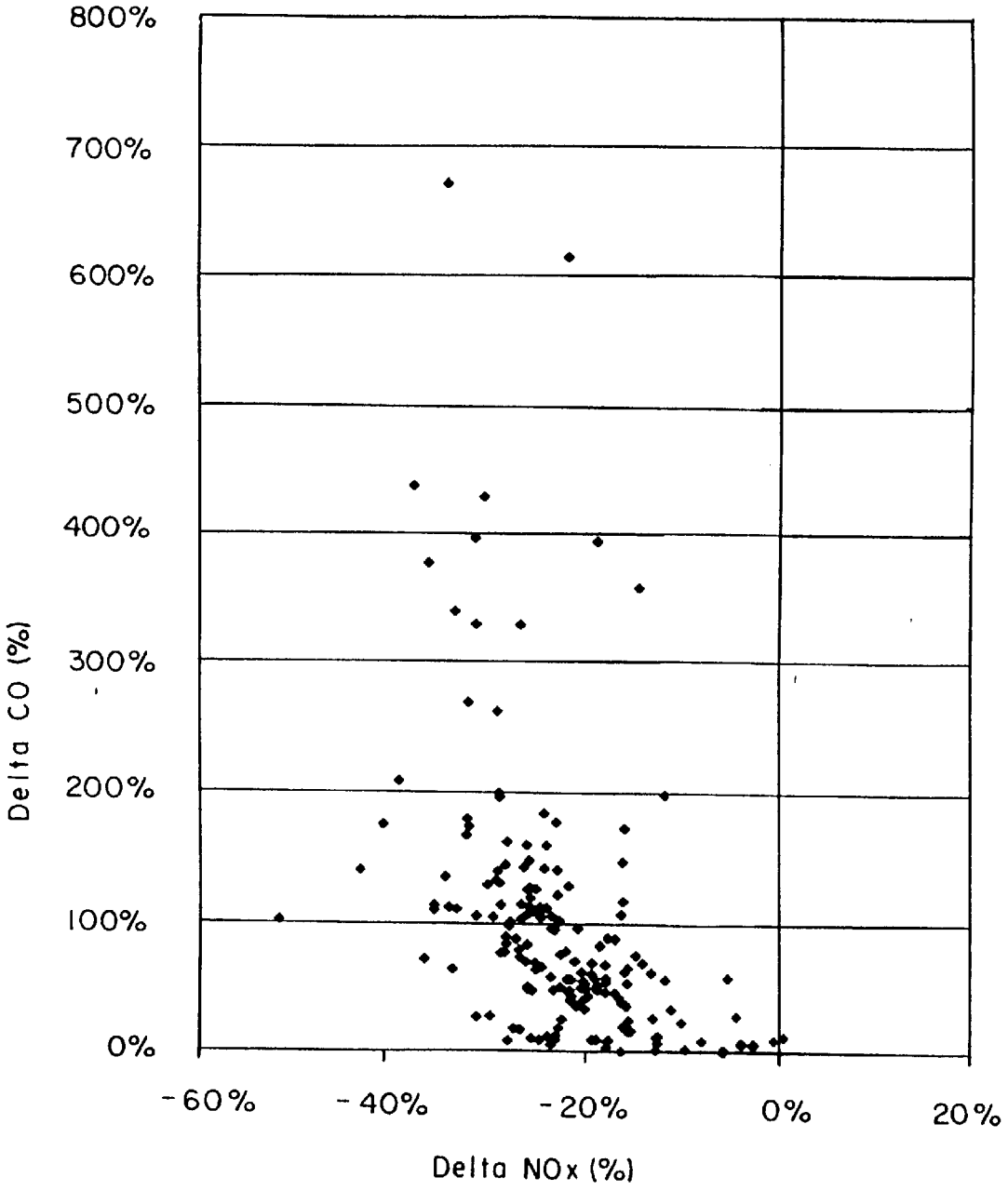

FIG. 26 shows that decreasing micelle size correlates with increasing CO emissions (Panel A), and confirms that increasing CO emissions correlates with increasing weight percent of water (Panel B) and decreasing NOx emissions (Panel C).

Figure 27:
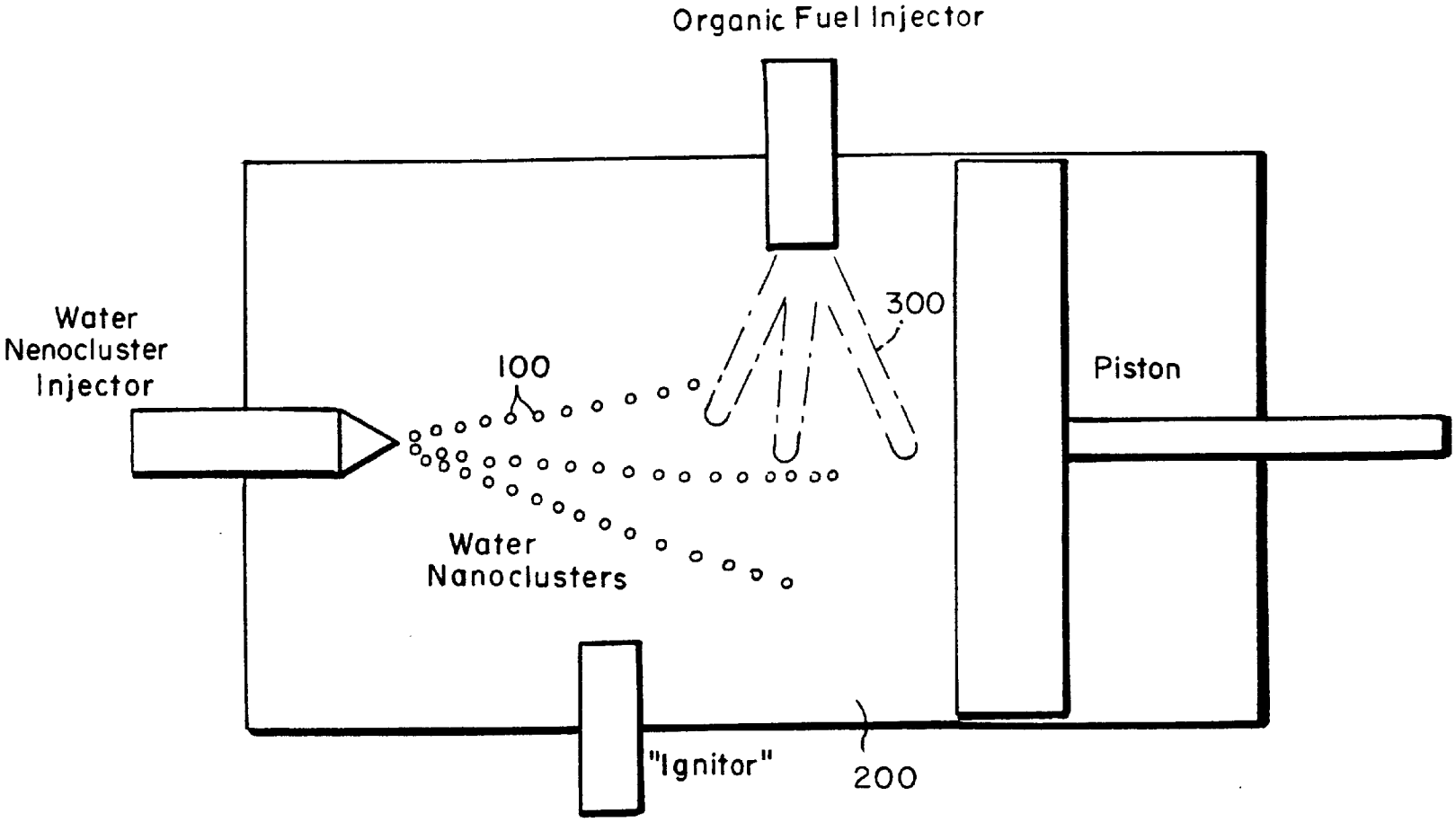

FIG. 27 depicts a new engine designed for combustion of water cluster/fuel compositions of the present invention.

DESCRIPTION OF PREFERRED EMBODIMENTS

As discussed above, the present invention encompasses a new theory of interactions between and among water molecules. In order to facilitate the understanding of the invention, we begin with a basic discussion of what is known about water structure.

Figure 1:
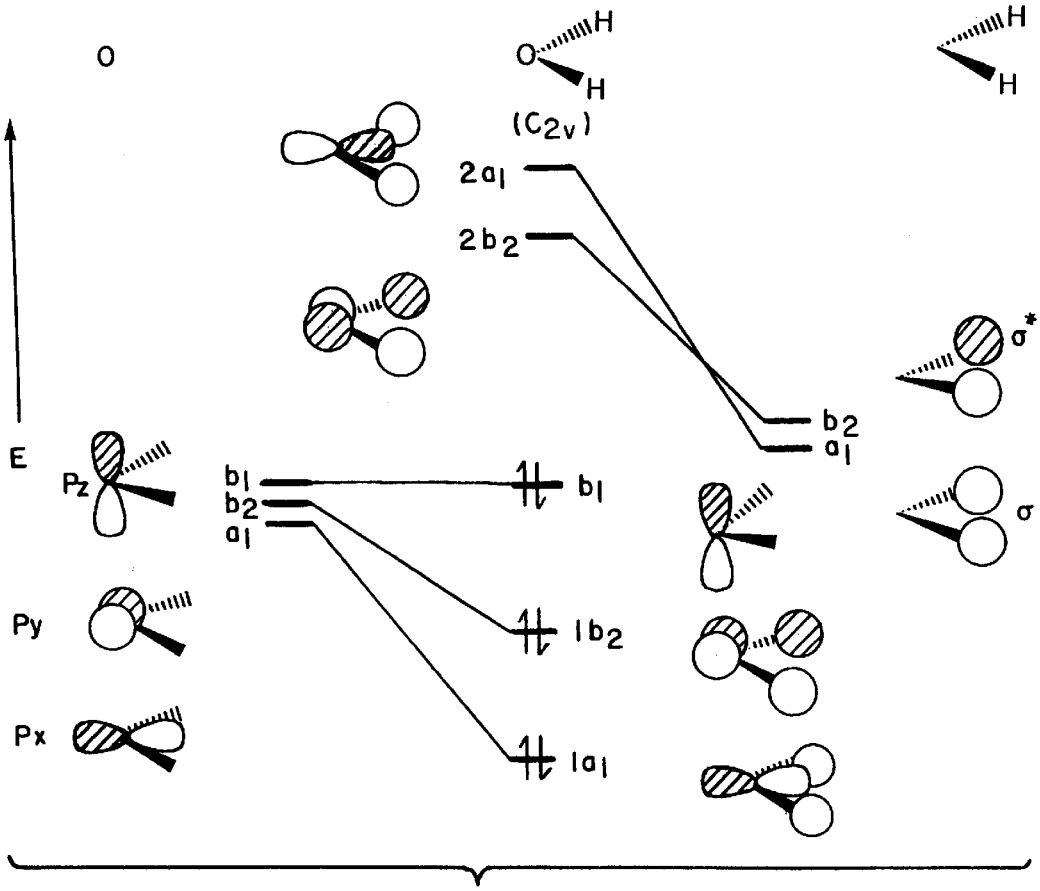
FIG. 1 depicts a representation of the molecular orbitals of water.

FIG. 1 depicts the molecular orbital structure of a single water molecule. As can be seen, this structure can be effectively modeled as an interaction between an oxygen atom (left side) and a hydrogen ($H_2$) molecule (right side). Oxygen has three p orbitals ($p_x$, $p_y$, and $p_z$) available for interaction with the hydrogen molecule's σ (bonding) and σ* (antibonding) orbitals. Interaction between the oxygen and the hydrogen molecule produces three bonding orbitals: one that represents a bonding interaction between the oxygen $P_x$ orbital and the hydrogen σ orbital; one that represents interaction of the oxygen $p_y$ orbital with the antibonding hydrogen σ* orbital; and one that represents the oxygen $p_z$ orbital. In FIG. 1, these orbitals are labelled with their symmetry designations, $1a_1$, $1b_2$, and $b_1$, respectively.

The oxygen/hydrogen molecule interaction also produces two antibonding orbitals: one that represents an antibonding interaction between the oxygen $p_y$ orbital and the hydrogen σ* orbital; and one that represents an antibonding interaction between the oxygen $p_x$ orbital and the hydrogen σ orbital. These orbitals are also given their symmetry designations, $2b_2$ and $2a_1$, respectively, in FIG. 1. For simplicity, the orbitals depicted in FIG. 1 will hereinafter be referred to by their symmetry designations. For example, the oxygen $p^z$ orbital present in the water molecule will be referred to as the water $b_1$ orbital.

Figure 2A:
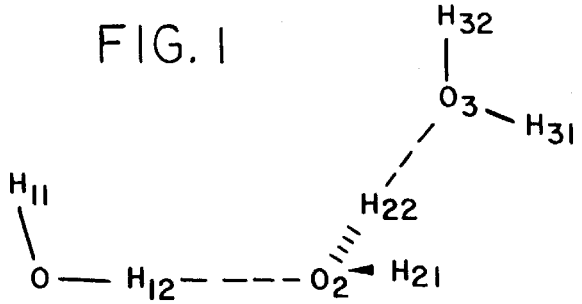
FIG. 2A shows the relative orientations of the atoms in neighboring molecules.
Figure 2B:
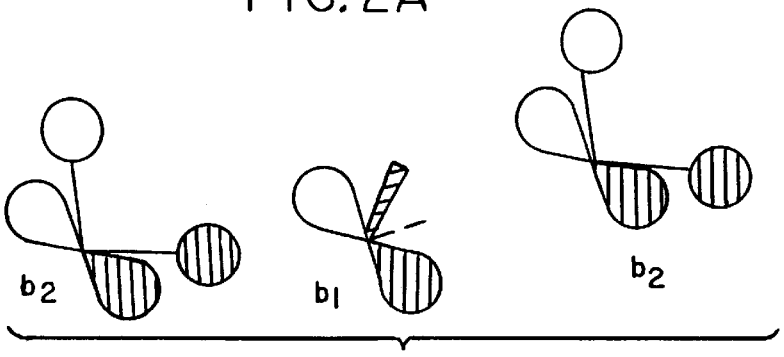
FIG. 2B shows the relative orientations of molecular orbitals.

The present invention provides the discovery that, when water molecules are positioned near each other in appropriate configurations, the $b_1$ orbital on a first water oxygen will interact with the $1b_2$ orbital on an adjacent, second water molecule, which in turn will interact with the $b_1$ orbital of a third adjacent water molecule, etc. As shown in FIG. 2, when successive water molecules are oriented perpendicular to one another (FIG. 2A), the $b_1$ and $1b_2$ orbitals on alternating molecules can interact (see FIG. 2B) to form delocalized pπ-type orbitals that extend along any number of adjacent waters.

Figure 3:
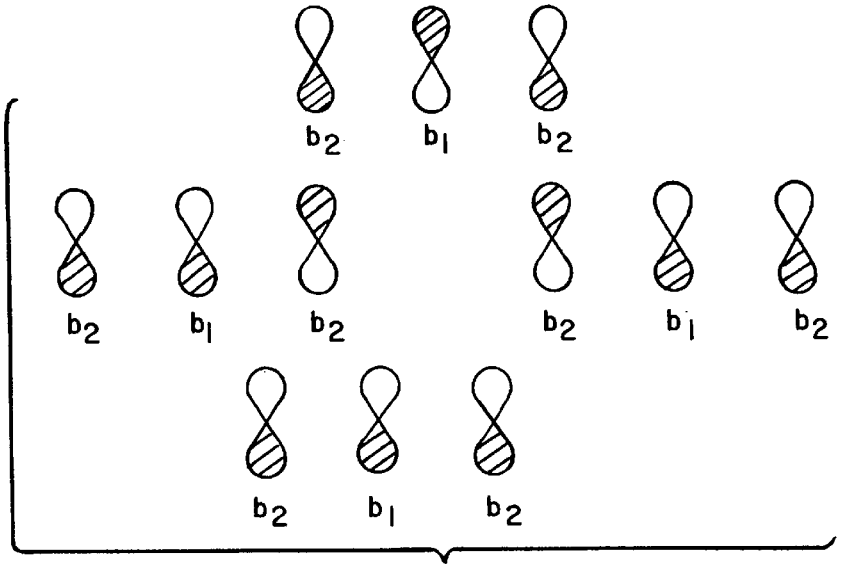
FIG. 3 presents pπ orbitals produced through interaction of three water molecules.
Figure 4:
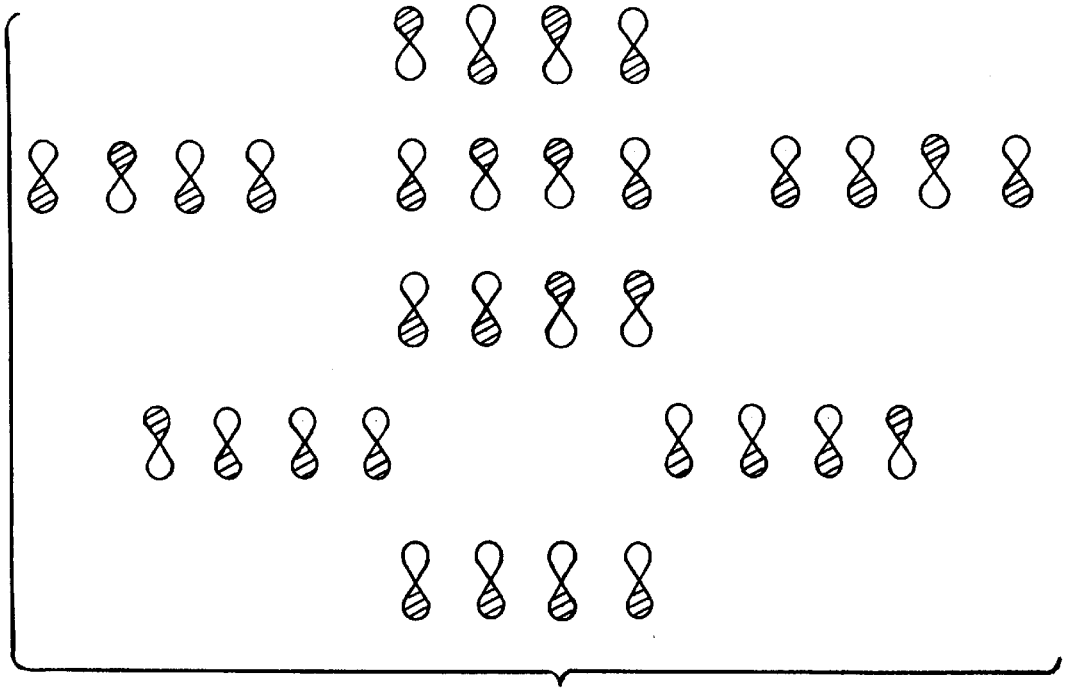
FIG. 4 presents pπ orbitals produced through interaction of four water molecules.

Those of ordinary skill in the art will readily appreciate that the larger the number of water molecules that are interacting with one another, the more different combinations of $b_1$ and $1b_2$ orbitals will be created, each producing a pπ orbital with a particular extent of bonding or antibonding character. For example, FIG. 3 presents possible orbitals produced by combinations of $b_1$ and $1b_2$ orbitals on three water molecules; FIG. 4 present possible pπ orbitals produced by combinations of $b_1$ and $1b_2$ orbitals on four water molecules. As can be seen, the larger the number of interacting water molecules, the larger the manifold of possible pπ orbitals.

It will be appreciated that both the $b_1$ and $1b_2$ orbitals in water are occupied. Accordingly, the oxygen-oxygen interactions described by the present invention involve interactions of filled orbitals. Traditional molecular orbital theory teaches that interactions between such filled orbitals typically do not occur because, due to repulsion between the electron pairs, the antibonding orbitals produced by the interaction are more destabilized than the bonding orbitals are stabilized. However, in the case of interacting oxygen atoms on adjacent water molecules, the interacting atoms are farther apart (about 2.8 Å, on average) than they would be if they were covalently bonded to one another. Thus, the electron-pair repulsion is weaker than it would otherwise be and such asymmetrical orbital splitting is not expected to occur. In fact, some "bonding" and "antibonding" orbital combinations can have substantially identical energies. The highest occupied molecular orbital (HOMO) in water is, therefore, a manifold of substantially degenerate pπ orbitals with varying bonding and antibonding character; the lowest unoccupied molecular orbital (LUMO) in water represents a manifold of states corresponding to interactions involving $2b_2$ orbitals an adjacent water molecules.

As described above, one aspect of the invention is the discovery that oxygen-oxygen interactions can occur among neighboring water molecules through overlap of $b_1$ and $1b_2$ orbitals on adjacent oxygens that produces degenerate, delocalized pπ orbitals. A further aspect of the invention is the recognition that such pπ orbitals can protrude from the surface of a water structure and can impart high reactivity to oxygens within that structure. The inventors draw an analogy between the presently described water oxygen pπ orbitals and dwr orbitals known to impart reactivity to certain chemical catalysts (see, for example Johnson, in *The New World of Quantum Chemistry*, ed. by Pullman et al., Reidel Publishing Co., Dorderecht-Holland, pp. 317–356, 1976). According to the present invention, water oxygens can be made to catalyze their own oxidative addition to other molecules by incorporating them into water structures in which pπ delocalized orbitals associated with oxygen-oxygen interactions protrude from the structure surface.

A further aspect of the invention provides the recognition that reactivity of water oxygens within structures having protruding pπ orbitals can be enhanced through amplification of certain oxygen-oxygen vibrational modes. It is known that the rate limiting step associated with oxidative addition of an oxygen atom from $O_2$ is the dissociation of the oxygen atom from the $O_2$ molecule. Thus, in general, oxygen reactivity can be enhanced by increasing the ease with which the oxygen can be removed from the molecule with which it is originally associated. The present inventors have recognized that enhancement of oxygen-oxygen vibrational modes in water clusters increases the probability that a particular oxygen atom will be located a distance from the rest of the structure. Where the oxygen is participating in interactions that create a protruding pπ orbital, displacement of the oxygen away from the structure increases the probability that the pπ orbital will have the opportunity to overlap with orbitals of a potential reaction partner, and therefore increases the reactivity of the oxygen atom. Essentially, the vibrations create an orbital steering effect.

The present invention therefore provides "water clusters" that are characterized by high oxygen reactivity as a result of their orbital and vibrational characteristics. A "water cluster", as that term is used herein, describes any arrangement of water molecules that has sufficient "surface reactivity" due to protruding pπ orbitals that the reactivity of cluster oxygens with other reactants is enhanced relative to the reactivity of oxygens in liquid water. Accordingly, so long as a sufficient number of pπ orbitals protrude from the cluster of water molecules in a way that allows increased interaction with nearby reactants, the requirements of the present invention are satisfied.

Preferred water clusters of the present invention have symmetry characteristics. Symmetry increases the degeneracy of the pπ orbitals, and also produces more delocalized orbitals, thereby increasing the "surface reactivity" of the cluster. Symmetry also allows collective vibration of oxygen-oxygen interactions within the clusters, so that the likelihood that a protruding pπ orbital will have an opportunity to overlap with a potential reactant orbital is increased. Particularly preferred water clusters comprise pentagonal arrays of water molecules, and preferably comprise pentagonal arrays with maximum icosahedral symmetry. Most preferred clusters comprise pentagonal dodecahedral arrays of water molecules.

Figure 5A:
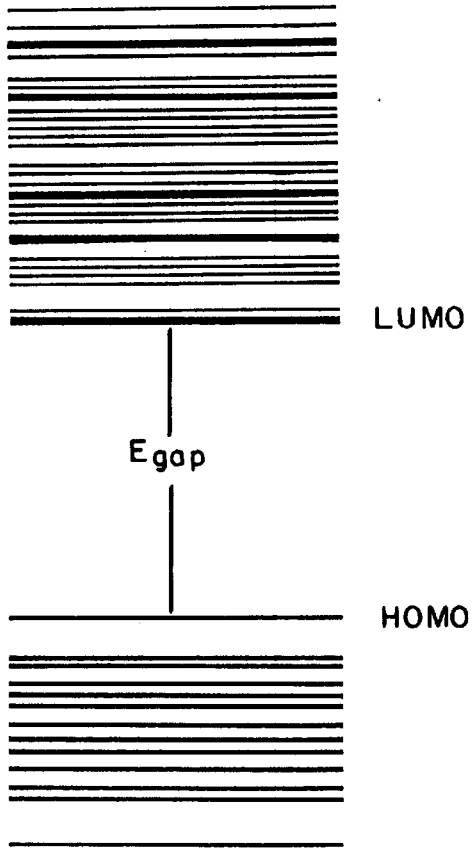
FIG. 5A shows the molecular orbital energy levels.
Figure 5B:
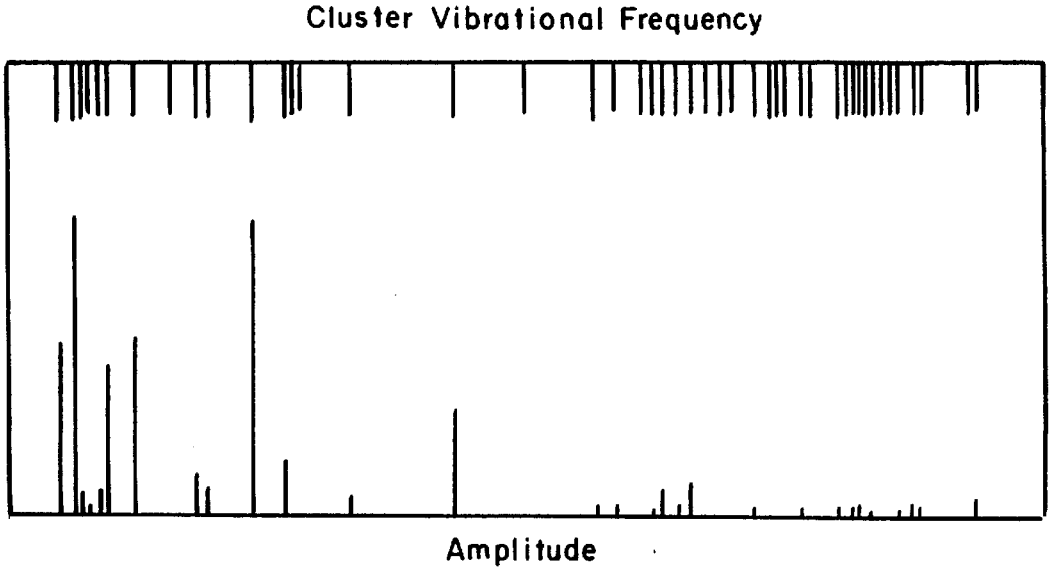
FIG. 5B displays the computed vibrational modes.
Figure 5C:
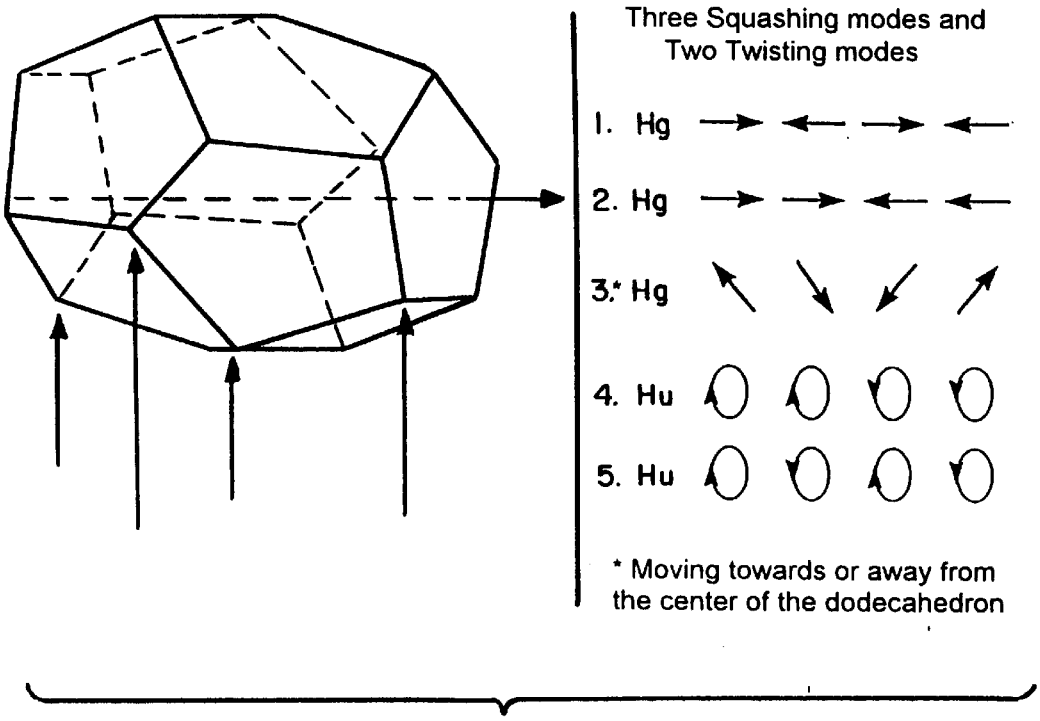
FIG. 5C depicts "squashing" and "twisting"

Water clusters comprising pentagonal arrays of water molecules are preferred at least in part because the vibrational modes that can contribute to enhanced oxygen reactivity are associated with the oxygen-oxygen "squashing" and "twisting" modes (depicted for a pentagonal dodecahedral water structure in FIG. 5). These modes have calculated vibrational frequencies that lie between the far infrared and microwave regions of the electromagnetic spectrum, within the range of approximately 250 $cm^{-1}$ to 5 $cm^{-1}$. Induction of such modes may be accomplished resonantly, for example through application of electrical, electromagnetic, and/or ultrasonic fields, or may be accomplished intrinsically through the dynamical Jahn-Teller effect.

As discussed above, the DJT effect refers to a symmetry-breaking phenomenon in which molecular vibrations of appropriate frequency couple with certain degenerate energy states available to a molecule, so that those states are split away from the other states with which they used to be degenerate (for review, see Bersuker et al., *Vibronic Interactions in Molecules and Crystals*, Springer Verlag, N.Y., 1990). Essentially, the Jahn-Teller effect (or the pseudo-Jahn-Teller effect) produces instability in high-symmetry structures that are in orbitally degenerate (or nearly degenerate) electronic states, causing the structures to distort or deform along symmetry-determined vibronic coordinates (Qs). The distorted structures have reduced-energy potential energy wells (A' in FIG. 6); the DJT effect can induce the large amplitude vibrations along vibronic coordinates that represent oscillations between these structures. These Jahn-Teller-induced potential minima, and the rapid dynamical-Jahn-Teller vibrations between them, can significantly lower the energy barrier for a chemical reaction (indicated as A→B in FIG. 7) involving the water structures. The reduction in energy barrier is qualitatively similar to that produced by a catalyst, but in this case the reaction pathway from the reactants A to the products B is predictably determined from symmetry by the DJT vibronic coordinates (Qs). Thus, natural coupling between the oxygen-oxygen vibrations and the degenerate pπ molecular orbitals of water clusters of the present invention can enhance oxygen reactivity.

Water clusters having pentagonal symmetry are particularly preferred for use in the practice of the present invention because adjacent pentagonal clusters repel each other, imparting kinetic energy to the clusters that can contribute to their increased reactivity.

It will be appreciated that not all of the molecules in the water clusters of the present invention need be water molecules per se. For example, molecules (such as alcohols, amines, etc.) that represent a substitution of a water hydrogen can be incorporated into water clusters of the invention without disrupting the oxygen-oxygen interactions. Methonal, ethanol, or any other substantially saturated alcohol is suitable in this regard. Other atoms, ions, or molecules (e.g., metal ions such as Cu and Ag) can additionally or alternatively be included in the structure so long as they don't interfere with formation of the reactive pπ orbital(s). Preferred atoms, ions, or molecules participate in and/or enhance the formation of the pπ orbitals. The water structures themselves may also be protonated or ionized. Given that not all of the molecules in the cluster need be water molecules, we herein describe certain desirable characteristics of inventive water clusters with reference to the number of oxygens in the cluster.

Preferred water clusters of the present invention are "nanodroplets", preferably smaller than about 20 Å in their longest dimension, and preferably comprising between about 5 and 300 oxygens. Particularly preferred clusters include between about 20 and 100 oxygens. Most preferred water clusters contain approximately 20 oxygens and have pentagonal dodecahedral symmetry.

Particular embodiments of preferred inventive water clusters for use in the practice of the present invention are presented in FIGS. 8–14 FIG. 8 shows a 5-molecule water cluster with pentagonal symmetry, FIG. 9 shows one of the pπ orbitals associated with this cluster. Solid lines represent the positive phase of the orbital wave function; dashed lines represent the negative phase. As can be seen with reference to FIG. 9, a delocalized pπ orbital forms that protrudes from the surface of the cluster. This orbital (and others) is available for interaction with orbitals of neighboring reaction partners. Overlap with an orbital lobe of the same phase as the protruding pπ orbital lobe will create a bonding interaction between the relevant cluster oxygen and the reaction partner.

FIG. 10 shows a 10-molecule water cluster with partial pentagonal symmetry; FIG. 11 shows one of its delocalized pπ orbitals. As can be seen, the orbital delocalization (and protrusion) is primarily associated with the water molecules in the pentagonal arrangement. Thus, FIG. 11 demonstrates one of the advantages of high symmetry in the water clusters of the present invention: the pπ orbital associated with the pentagonally-arranged water molecules is more highly delocalized and protrudes more effectively from the surface. The orbital therefore creates surface reactivity not found with the oxygens in water molecules that are not part of the pentagonal array.

FIG. 12 shows a 20-molecule water cluster with pentagonal dodecahedral symmetry; FIG. 13, Panels A–E show various of its pπ orbitals. Once again, extensive orbital delocalization and surface protrusion is observed in this highly symmetrical structure. For comparison, the normally unoccupied culster molecular orbitals associated with the same structure are depicted in FIGS. 14–16. More delocalization is observed over the cluster surface, implying greater reactivity when these orbitals become occupied (e.g., through Jahn-Teller symmetry breaking or through electronic charge addition.

Water clusters comprising more than approximately 20 water molecules are not specifically depicted in Figures presented herein, but are nonetheless useful in the practice of the present invention. For example, clusters comprising approximately 80 molecules can assume an ellipsoidal configuration with protruding pπ orbitals at the curved ends. When clusters comprise more than approximately 300 water molecules, however, the cluster tends to behave more like liquid water, which shows low "surface reactivity." Of course, if the cluster were to comprise a large number (>300) of water molecules all arranged in stable symmetrical structures (e.g., several stable pentagonal dodecahedral), these problems would not be encountered. Such "aggregates" of the inventive water clusters are therefore within the scope of the present invention.

As has been mentioned, water clusters comprising pentagonal dodecahedral molecular arrangements are particularly preferred for use in the practice of the present invention. Accordingly, pentagonal dodecahedral water structures are discussed in more detail below. Those of ordinary skill in the art will appreciate, however, that the following discussion is not intended to limit the scope of the present invention, and that any and all embodiments encompassed by the above broad description fall within the scope of the claims.

Pentagonal Dodecahedral Water Clusters

Pentagonal dodecahedral water structures (such as, for example, $(H_2O)_{20}$, $(H_2O)_{20}^{++}$, $(H_2O)_{20}H^+$, $(H_2O)_{21}H^+$,and $(H_2O)_{20}^-$, as well as analogous structures including alcohol molecules) are particularly preferred for use in the practice of the present invention because, as shown in FIG. 13, delocalized pπ orbitals protrude from the dodecahedron vertices, so that all 20 oxygens in the structure are predicted to have enhanced reactivity. Furthermore, Coulomb repulsion between like-charged dodecahedra can render pentagonal dodecahedral structures kinetically energetic. Also, the symmetry of the structure produces degenerate molecular orbitals that can couple with oxygen-oxygen vibrational modes in the far infrared to microwave regions, resulting in increased reactivity of the structure oxygens. As discussed above, these modes can be induced through application of appropriate fields, or through the dynamical Jahn-Teller effect.

Quantum mechanics computations reveal that the Jahn-Teller-active molecular orbitals of a pentagonal dodecahedral water cluster have protruding lobes available for overlap with orbitals of potential reaction partners (see FIGS. 13–16); certain of the orbitals have the shapes of large "s", "p", and "d" atomic-like orbitals (see FIGS. 14–16) that are spatially delocalized around the surface oxygen atoms of the cluster. It is the availability of these orbitals, particularly the "p-like" and "d-like" ones, that allows the clusters to "catalyze" and/or provide their oxygens to various chemical reactions. The rate constant for reactions is given by the equation:

$$\kappa = Ae^{-E_{barrier}/RT}$$

The pre-exponential term, A, in this equation increases with the frequency of collision (orbital overlap) between water clusters and their potential reaction partners. This collision frequency, in turn, increases with the effective collisional cross-sectional areas of the reactants, which is proportional to the square of the reactant molecular-orbital diameter, d. Pentagonal dodecahedral water clusters have a relatively large molecular orbital diameter (~8 Å). Furthermore, this diameter is effectively increased through the action of the Jahn-Teller-induced low frequency vibrational modes (see, e.g. FIG. 5). Thus, when $E_{barrier}$ is low pentagonal dodecahedral waters are likely to be significantly more reactive than liquid waters. As described above, $E_{barrier}$ is lowered by coupling with the DJT-induced symmetry-breaking low frequency vibrational modes. Furthermore, the coupling of electrons and DJT-induced cluster vibrations can lead to the conversion of electronic energy to vibronic energy, so that the potential energy of the cluster is increased by $\Delta E_{vib}$ (see FIG. 6), resulting a further effective lowering of the energy barrier separating reactants and products.

It should be noted that pentagonal dodecahedral water structures had been produced and analyzed well before the development of the present invention. As early as 1973, researchers were reporting unexpected stabilities of water clusters of the form $H^+(H_2O)_{20}$ and $H^+(H_2O)_{21}$ (see, for example, Lin, *Rev. Sci. Instrum.* 44:516, 1973; Searcy et al., *J. Chem. Phys.* 61:5282, 1974; Holland et al., *J. Chem. Phys.* 72:11, 1980; Yang et al., *J. Am. Chem. Soc.* 111:6845, 1989; Wei et al., *J. Chem. Phys.* 94:3268, 1991). However, prior art analyses of these structures centered around discussions of hydrogen bond interactions, and struggled to explain their structure and energetics (see, for example, Laasonen et al., *J. Phys. Chem.* 98:10079, 1994). No prior art reference discussed the oxygen-oxygen interactions described herein, and none recognized the increased reactivity of cluster oxygens. Moreover, no prior art reference recognized the desirability of inducing particular vibrational modes in these clusters in order to increase oxygen reactivity.

On the other hand, certain elements of the data collected in prior art studies are consistent with and can be explained by the theory presented herein. For example, the present invention predicts that low-frequency vibrations attributable to oxygen-oxygen bonds at the vertices of pentagonal dodecahedral structures should be observable by Raman scattering. Several groups have reported low frequency Raman scattering in water (see, for example, Rousset et al., *J. Chem. Phys.* 92:2150, 1990; Majolino et al., *Phys. Rev. E*47:2669, 1993; Mizoguchi et al., *J. Chem. Phys.* 97:1961, 1992), but each has offered its own explanation for the effect, none of which involves vibrations of oxygen-oxygen bonds at the vertices of pentagonal dodecahedral structures. In fact, Sokolov et al. recently, summarized the state of understanding of the observed low frequency vibrations by saying "the description of the spectrum and its relation with the critical behavior of other properties are still not clear" (Sokolov et al., *Phys. Rev. B* 51:12865, 1995). The present invention solves this problem.

The analysis of water structure provided by the present invention explains several observations about water properties that cannot be understood through studies of hydrogen bond interactions. For example, Seete et al. (*Phys. Rev.* Lett 75:850, 1995) have reported propagation of "fast sound" through liquid water is not dependent on the hydrogen isotope employed. Accordingly, fast sound cannot be propagating only on the hydrogen network.

According to the present invention, preferred pentagonal dodecahedral water structures include $(H_2O)_{20}$, $(H_2O)_{20}^{++}$, $(H_2O)_{20}H^+$, $(H_2O)_{21}H^+$, and $(H_2O)_{20}$. Also preferred are structures including one or more alcohol molecules, or other molecules (e.g., surfactants) that can contribute to the desirable delocalized electronic structure, substituted for water. Preferred structures may also include clathrated (or otherwise bonded) ions, atoms, molecules or other complex organic or metallo-organic ligands. In fact, clathration can act to stabilize pentagonal dodecahedral water structures. Preferred clathration structures include $(H_2O)_{21}H^+$ structures in which an $H_3O^+$ molecule is clathrated within a pentagonal dodecahedral shell. Other preferred clathrated structures include those in which a metal ion is clathrated by pentagonal dodecahedral water. Negatively charged structures are particularly preferred; such structures contain one or more electrons in the above-described normally unoccupied orbital and are even more reactive than the neutral and positively charged species. Any water structure in which an electron has been introduced into the above-mentioned orbital is a "negatively charged" structure according to the present invention.

Water clusters containing stable pentagonal dodecahedral water structures may be produced in accordance with the present invention by any of a variety of methods. In liquid water, pentagonal dodecahedral structures probably form transiently, but are not stable. In fact, liquid water can be modeled as a collection of pentagonal dodecahedra in which inter-structure interactions are approximately as strong as, or stronger than, intra-structure interactions. Accordingly, in order to produce stable pentagonal dodecahedral water structures from liquid water, the long-range inter-structure interactions present in liquid water must be disrupted in favor of the intra-structure association. Any of a variety of methods, including physical, chemical, electrical, and electromagnetic methods, can be used to accomplish this. For example, perhaps the most straightforward method of isolating pentagonal dodecahedral water structures is simply to isolate 20 or 21 water molecules in a single nanodroplet. Preferred water clusters of the present invention comprise 20 to 21 water molecules.

Other methods of producing pentagonal dodecahedral water structures include passing water vapor through a hypersonic nozzle, as is known in the art (see, for example Lin, *Rev. Sci. Instrum.* 44:516, 1973; Searcy et al., *J. Chem. Phys.* 61:5282, 1974). All known methods of hypersonic nozzling are useful in accordance with the present invention. The present invention, however, also provides an improved hypersonic nozzling method for preparing pentagonal dodecahedral water structures. Specifically, in a preferred embodiment of the present invention, the hypersonic nozzle comprises a catalytic material such as nickel or a nickel alloy positioned and arranged so that, as water passes through the nozzle, it comes in contact with reacting orbitals on the catalytic material. Under such conditions, the catalytic material is expected to disrupt inter-cluster bonding, by sending electrons into anti-bonding orbitals, without interfering with intra-cluster bonding interactions.

Chemical methods for producing water clusters comprising pentagonal dodecahedral structures include the use of surfactants and/or clathrating agents. Electrical methods include inducing electrical breakdown of inter-cluster interactions by providing an electrical spark of sufficient voltage and appropriate frequency. Electromagnetic methods include application of microwaves of appropriate frequency to interact with the "squashing" vibrational modes of inter-cluster oxygen-oxygen interactions. Also, since it is known that ultrasound waves can cavitate (produce bubbles in) water, it is expected that inter-cluster associations can be disrupted ultrasonically without interfering with intra-cluster interactions. Finally, various other methods have been reported for the production of pentagonal dodecahedral water structures as can be employed in the practice of the present invention. Such methods include ion bombardment of ice surfaces (Haberland, in *Electronic and Atomic Collisions*, ed. by Eichler et al., Elsevier, Ansterdam, pp. 597–604, 1984), electron impact ionization (Lin, *Rev. Sci. Instrum.* 44:516, 1973; Hermann et al., *J. Chem. Phys.* 72:185, 1982; Dreyfuss et al., *J. Chem. Phys.* 76:2031, 1982; Stace et al., *Chem. Phys. Lett.* 96:80, 1983; Echt et al., *Chem. Phys. Lett.* 108:401, 1989), and near-threshold vacuum-UV photoionization of neutral clusters (Shinohara et al., *Chem. Phys.* 83:4183, 1985; Nagashima et al., *J. Chem. Phys.* 84:209, 1986)].

However the pentagonal dodecahedral water structures are initially produced, it may be desirable to ionize them (e.g., by passing them through an electrical potential after they are formed) in order to increase their kinetic energy, and therefore their reactivity, through coulombic repulsion.

As mentioned above, negatively charged structures are particularly useful in the preactice of the present invention. Such negatively charged structures may be produced, for example, chemically (e.g., by selecting a surfactant or additive that contributes one or more electrons to the LUMO), by direct addition of one or more electrons to the LUMO (e.g., by means of an electronic injector), or, if the energy gap between the HOMO and the LUMO is of the appropriate size, photoelectrically (e.g., using uv light to excite an electron into the LUMO). Of course, any other available method that successfully introduces one of more electrons into the LUMO may latematively be used.

Applications

As described above, the present invention provides reactive water clusters reactive oxygens. The invention also provides methods of using such clusters, particularly in "oxidative" reactions (i.e., in reactions that involve transfer of an oxygen from one molecule to another). The clusters can be employed in any oxidative reaction, in combination with any appropriate reaction partner.

One particularly useful application of the water structures of the present invention is in combustion. According to the present invention, the reactive water oxygens can efficiently combine with carbon in a fuel so that the specific energy of the combustion reaction is increased.

In order to model the reactivity of water structure oxygens with neighboring carbons, the inventors have analyzed pentagonal dodecahedral water clusters ionteracting with aromatic molecular soot precursors and $C_{16}H_{34}$ (cetane-diesel) fuel molecules. FIGS. 17 and 18, respectively, present calculated highest occupied pπ orbitals for these structures. As can be seen with both structures, electron density between the carbon and oxygen is high.

The structures depicted in FIGS. 17 and 18 model systems in which an isolated pentagonal dodecahedral water cluster is surrounded with hydrocarbon molecules. The high electron density between the cluster oxygen and adjacent carbon indicate that the likelihood that the oxygen will be oxidatively added to the carbon is increased. Thus, the present invention teaches that dispersions of water clusters in fuel should have enhanced specific energy of fuel combustion as compared with fuel alone. Also, the invention teaches that the dispersed water molecules promote combuistion of soot molecules, thereby reducing particular matter emmissions. Accordingly, one aspect of the present invention comprises combustible compositions comprising water clusters dispersed in fuel. The compositions are designed to include water structures with reactive oxygens and to maximize interaction of the fuel with those oxygens.

Fuels that can usefully be employed in the water cluster/fuel compositions of the present invention include any hydrocarbon source capable of interaction with reactive oxygens in water clusters of the present invention. Preferred fuels include gasoline and diesel. Diesel fuel is particularly preferred.

Water cluster/fuel compositions of the present invention may be prepared by any means that allows formation of water clusters with reactive oxygens and exposes a sufficient number of such reactive oxygens to the fuel so that the specific energy of combustion is enhanced as compared to the specific energy observed when pure fuel is combusted under the same conditions.

For example, in one preferred embodiment of the invention, the compositions are prepared by combining fuel and water together under supercritical conditions. Water has a critical temperature of 374° C. Above this temperature, no amount of hydrostatic pressure will initiate a phase change back to the liquid state. The minimum pressure required to reliquify water just below its critical temperature, known as the critical pressure, is 221 atmospheres. Provisional application entitled "Supercritical Fuel and Water Compositions", filed on even date herewith and incorporated herein by reference, discloses that single-phase fuel/water compositions can be prepared under supercritical conditions. Without wishing to be bound by any particular theory, we propose that such single-phase compositions represent water clusters of the present invention dispersed within the fuel. Accordingly, desirable water cluster/fuel compositions of the present invention may be prepared through supercritical processing as described in the above-mentioned, incorporated provisional application.

In an alternative preferred embodiment of the present invention, the inventive water cluster fuel compositions are prepared by a process in which stable water structures that contain reactive oxygens are prepared prior to introduction of the water into the water cluster/fuel compositions. Surfactants may be employed to stabilize the water cluster/fuel compositions if desired.

When utilized, surfactants should be selected to participate in the desired electronic and vibrational characteristics of the water clusters. Preferred surfactants also donate one or more electrons to the water cluster LUMO. Particularly preferred surfactants are characterized by one or more of the following additional features: i) low cost; ii) high density as compared with fuel; iii) viscosity approximating that of the fuel (so that the composition flows freely through a standard diesel engine); iv) ready miscibility with other fuel components; v) absence of new toxicities (so that the inventive composition is no more toxic than the fuel alone); vi) stability to exposure to temperatures as low as −30° C. and as high as 120° C.; and vii) ability to form an emulsion composition with the fuel and water that is stable for at least about one year.

Preferred inventive surfactant-containing combustible compositions utilize surfactants with relatively oxygen-rich hydrophilic ends. For example, preferred surfactants have carboxyl (COOH), ethoxyl ($CH_2$—O), $CO_3$, and/or $NO_3$ groups. Preferably, the surfactant also has at least one long (preferably 6–20 carbons) linear or branched hydrophobic tail that is soluble in the fuel. Compositions containing carboxylate surfactants preferably also contain a neutralizing base such as ammonia ($NH_4OH$) or methyl amine (MEA). Typically, the secondary surfactant is relatively less polar than the primary surfactant (e.g., is an alcohol) and interacts less strongly with the water phase, but has a hydrocarbon tail that orients and controls the primary surfactant, for example through van der Waals interactions. Preferred primary surfactants for use in accordance with the present invention include fatty acids having a carboxylate polar group. For example, oleic acid, linoleic acid, and stearic acid are preferred primary surfactants.

FIG. 19 depicts a water cluster interacting with a typical fatty acid by sharing molecular orbitals, according to the present invention. As can be seen with reference to FIG. 19, surfactant molecular orbitals effectively donates an electron to and participate in the delocalized pπ water cluster orbital.

Other components may also be included in the inventive combustible compositions. For example, as discussed above, it is sometimes desirable to add one or more neutralizing agents. Particularly where the surfactant is an organic acid such as, for example, a fatty acid (e.g., see FIG. 19), such neutralizing agents are likely to be desirable. Examples of preferred neutralizing agents include, but are not limited to methyl amine and ammonia. Addition of such a neutralizing agent has the effect of placing a nitrogen atom at the center of the water cluster, thereby promoting electron delocalization to the cluster periphery, for example as shown in FIG. 20.

It is important to note that the present invention is not the first description of the use of surfactants in combustible water/fuel compositions. However, the prior art does not include identification of the desirable water clusters as described herein, nor of the appropriate surfactants selected for interaction with the water cluster molecular orbitals.

In order that the fuel in the water cluster/fuel compositions of the present invention be exposed to the maximum number of reactive oxygens, it is desirable to minimize the size of the water clusters in the water cluster/fuel compositions, therefore increasing the combustion efficiency. Preferably, the water clusters have an average diameter of no more than about 20 Å along their longest dimension. More preferably, each cluster comprises fewer than about 300 water molecules. In particularly preferred embodiments, the water cluster/fuel composition comprises individual pentagonal dodecahedral water clusters dispersed within the fuel.

It will be appreciated that the extent of interaction between the hydrocarbon fuel and reactive oxygens in the water will depend not only on the size (and surface reactivity) of the water clusters in the composition, but also on the number of water clusters dispersed within the fuel. Preferred water cluster/fuel compositions contain between about 1% and 20% water, preferably between about 3% and 15% water, and most preferably between about 5% and 12% water. Particularly preferred water cluster/fuel compositions contain at least about 50% water.

As mentioned above, the water cluster/fuel compositions of the present invention are preferably prepared so that the specific energy of combustion is as close as possible to that of pure fuel. Preferably, the specific energy is at least about 85%, more preferably at least about 90%, and yet more preferably at least about 95–99% that of pure fuel. In some particularly preferred embodiments, the specific energy of combustion of inventive compositions is higher than that of pure fuel. Preferably, the specific energy is increased at least about 1-2%, more preferably at least about 10%, still more preferably at least about 15–20%, and most preferably at least about 50%.

As described in the Examples, we have prepared various water cluster/fuel compositions and have tested their combustive properties in a standard diesel engine, under normal operating conditions. As can be seen, emission data compiled from combustion of these emulsions, and reveals that $NO_x$ and particulate emissions are reduced upon combustion of the inventive emulsions; CO levels are increased.

The water phase of the inventive emulsions described in Example 1 had a particle size of about 4–7 Å. Moreover, the phase was shown to include inventive water clusters, characterized by oxygen-oxygen vibrational modes. Specifically, an isotope effect was observed in the region of about 100–150 $cm^{-1}$ of the Raman spectra of emulsions containing $H_2O^{18}$ (see FIG. 22). This effect reveals that vibrations including oxygens are responsible for the spectral lines observed in that region.

The emulsion analyses described in Example 2 showed that decreasing water cluster size (micelle size) correlated with i) increases in the weight percent of water in the composition; ii) decreases in $NO_x$ emission; iii) increases in CO emission; and iv) increases in combustion efficiency. Interestingly, previous reports had reported that $NO_x$ emissions could be reduced in prior art combustible composition by decreasing the combustion temperature. Since reductions in combustion temperature are expected to restrict the extent of combustion, these reports would suggest that CO levels would decrease in parallel with $NO_x$ levels. We observe the opposite, presumably because the inventive compositions increase, rather than decrease, the extent of combustion by providing appropriate electronic configurations. Thus, combustion of inventive emulsions results in lower $NO_x$ emission but higher CO emission than combustion of diesel alone.

The results presented in the Examples were achieved by combusting diesel or water cluster/diesel emulsions in a standard diesel engine. The present invention can therefore readily be implemented with existing technology. However, an additional aspect of the invention involves altering the design of engines used in combustion of water cluster/fuel compositions of the present invention.

One embodiment of an altered engine for use in the practice of the present invention is a derivative of standard diesel engine, altered so as not to have a functional air intake valve. Given that the oxygen used in combustion of the inventive water cluster/fuel compositions can come from the water instead of from air, air intake should not be required.

More dramatic changes in engine design are also envisioned. For example, FIG. 23 presents one embodiment of a new engine for combusting water cluster/fuel compositions of the present invention. As shown, water clusters 100 are injected into a chamber 200, into which fuel 300 is also injected. The water clusters may be prepared by any of the means described above, but preferably are prepared by ejection from a hypersonic nozzle. In preferred embodiments, the nozzle comprises a catalytic material. In some embodiments, the clusters are also ionized by passage through a potential.

As has been discussed herein, it is desirable to expose the fuel to the water clusters in a way that maximizes interaction between fuel carbons and water oxygens. Because pentagonal dodecahedral water structures have high surface reactivity particularly preferred embodiments of the invention inject individual pentagonal dodecahedral water structures into the chamber. One additional advantage of injecting water clusters into a chamber, and particularly of injecting individual pentagonal dodecahedral water structures, is that it allows the Coulombic repulsion between individual water clusters to be harnessed as kinetic energy, thereby increasing the energy available for conversion during combustion.

Once inside the chamber, the water cluster/fuel composition is ignited according to standard procedures. As mentioned above, air intake is not required.

Those of ordinary skill in the art will appreciate that many of the known variations to engine structure and combustion conditions may be incorporated into the present invention. For example, various additives may be included in the water cluster/fuel composition in order to improve combustibility, stability, lubricity, corrosion-resistance or other desirable characteristics.

EXAMPLES

Example 1

Preparation and Analysis of Combustible Water Cluster/Fuel Emulsions

Water cluster/fuel emulsions were prepared according to the following method:

| COMPONENT | AMNT/GALLON EMULSION |
|---|---|
| Diesel | 0.55 Gal |
| Water | 0.22 Gal |
| Surfactant I | 1.07 lb |
| Surfactant II | 0.27 lb |
| Surfactant III | 0.10 Gal |

The water can be distilled water or tap water, or a mixture of water and a short chain alcohol such as methanol. Surfactant I has the structure $C_xH_{20}(OCH_2CH_2)_yOH$, where x=8–10 and y=4–10. Surfactant II is a polyglyceril-oleate or cocoate. Surfactant III is a short chain, ($C_{2-8}$) linear alcohol.

The emulsions were prepared by mixing the Diesel with Surfactant I and II. Water and surfactant III were then added simultaneously. The water nanodroplets in the emulsion had a grain size of about 4–7 Å. Two particular formulations were prepared that had the following components:

| Component | Amount (g) |
|---|---|
| Formulation 1 | |
| hexaethoxyoctanol | 155.5 |
| polyglyceril-oleate | 25.9 |
| diesel | 592.5 |
| water | 148.4 |
| pentanol | 77.7 |
| Formulation 2 | |
| hexaethoxyoctanol | 148.7 |
| polyglyceril-oleate | 37.2 |
| diesel | 504.8 |
| water | 216.3 |
| 40:60 butanol:hexanol | 9.29 |

Raman spectra of Formulation 2, were taken using laser excitation at both 406.7 nm and 647.1 nm. The spectra at 406.7 nm were highly fluorescent and only anti-stokes scattering/emission was carefully examined. The results at 647.1 nm did not have these problems. Isotope shift experiments were performed by introducing $H_2O^{18}$ into the emulsions. The $H_2O/H_2O^{18}$ difference spectrum is presented as FIG. 22. As can be seen, a peak was observed around 100–150 $cm^{-1}$, in the region associated with oxygen-oxygen squashing vibrational modes. Accordingly, it was concluded that the Formulation 2 emulsion contained water clusters having at least pentagonal symmetry.

The water cluster/fuel emulsions were weighed and then were pumped into a small YANMAR diesel engine. Energy output, injection timing, and engine operation were monitored according to standard techniques. Exhaust samples were taken and emissions were analyzed also according to standard techniques.

FIG. 21 presents the results of emissions analysis of two water cluster/fuel emulsions, Formulation 1 and Formulation 2. As can be seen, $NO_x$ and particulate levels are reduced, and CO levels may be increased.

Example 2

Preparation and Analysis of Combustible Water Cluster/Fuel Emulsions:

Water cluster/fuel emulsions were prepared according to the following method:

The fatty acid based microemulsion fuels were made by mixing of diesel fuel, partially neutralized fatty acid surfactant, water, and an alcohol co-surfactant. The fuel is Philips D-2 Diesel or the equivalent. The water is distilled water or tap water. Alcohol co-surfactants utilized include t-butyl alcohol (TBA), n-butyl alcohol (NBA), methyl benzyl alcohol (MBA) and methanol (MeOH), isopropyl alcohol (IPA), and t-amyl alcohol (TAA). Fatty acids include tall oil fatty acids (TOFA) and Emersol 315 (E-315) refined vegetable fatty acid. Specifically, the fatty acid should be only partially neutralized, with the optimum degree of neutralization depending on the specific alkanolamine used. MEA (monoethanolamine) was preferably used to neutralize the fatty acid by gradual addition to the fatty acid during mixing.

When a (macro)emulsion is first made from diesel, surfactant and water (without the alcohol), the mixture converts to a microemulsion within seconds of addition and mild mixing of the alcohol co-surfactant. When mixing the components sequentially, the order of addition affects the ease of mixing. It is more difficult to disperse water when it is added last due to the formation of localized streamers of waxy precipitates, which require more intense mixing to disperse and form the final microemulsion.

Additionally, "microemulsifier concentrates", consisting of all the ingredients needed to form a microemulsion except the base fuel itself, can be mixed without difficulty to form low viscosity, single phase mixtures (i.e. no gels). The concentrates can then be blended directly with diesel fuel with moderate mixing, to form water-in-oil microemulsion fuels.

The particular formulations that were prepared are shown in Appendix A.

The water cluster/fuel emulsions were weighed and then were pumped into a small YANMAR diesel engine. Energy output, injection timing, and engine operation were monitored according to standard techniques. Exhaust samples were taken and emissions were analyzed also according to standard techniques.

FIGS. 23–26 present the results of emissions analysis of several water cluster/fuel emulsions.

OTHER EMBODIMENTS

Those of ordinary skill in the art will recognize that the foregoing has provided a detailed description of certain preferred embodiments of the invention. Various changes and modifications can be made to the particular embodiments described above without departing from the spirit and scope of the invention. All such changes and modifications are incorporated within the scope of the following claims.

APPENDIX A

QET Fuel Sample Number: QF-0065-01
Formulation and Composition

| | | amnt (grams) | cost ($/lb) | specific grav | wt % $H_2$ |
|---|---|---|---|---|---|
| Fuel | | | | | |
| Phillips D-2 | | 382.5 | 0.0875 | 0.84 | 14.1 |
| | | 0 | 0 | 0 | 0.0 |
| | Total: | 382.5 | | | |
| Surfactant | | | | | |
| TOFA w/45% NH3 | | 45 | 0.29 | 0.91 | 14.7 |
| | | 0 | 0 | 0 | 0.0 |
| | Total: | 45 | | | |
| Water | | 50 | 0 | 1.000 | 0.000 |
| Co-Surfactant | | | | | |
| n-Pentanol | | 22.5 | 0.22 | 0.81 | 13.6 |
| | | 0 | 0 | 0 | 0.0 |
| | Total: | 22.5 | | | |
| Cetane Enhancer | | | | | |
| | | 0 | 0 | 0 | 0.0 |
| | | 0 | 0 | 0 | 0.0 |
| | Total: | 0 | | | |
| Total Emulsion: | | 500 grams | | | 12.74% |

Mixing Notes:

Fuel Ratios:

wt % Water: 10.00%
wt % Surfactant Package: 13.50%
(Surf + Co-Surf)/Water: 1.35
Surfactant: Co-Surf Ratio: 2.00

-continued

APPENDIX A

Measured Parameters
Heat of Combustion Information for "Fuels"

Emulsion Density (calculated): 0.8609 grams/cc
Emulsion Density (measured): 0.0000 grams/cc DLS Data:

Micelle Size: 1 nm
Intensity (Count Rate): 19
Polydispersity: 0.190
Emulsion Viscosity: 0 centipoise
Refractive Index: 1.450
Surface Tension: 0 dynes/cm Bomb Data:

Higher Heating Value: 17025.5 Btu/lb
Lower Heating Value: 15862.8 Btu/lb
Combustibility Number: 0.88
Comments:

Standard Fuel Consumption

| Diesel Reference Runs | and Engine parameters |
|---|---|
| SFC (Mass): 0.060000 g fuel/hp-s | Delta SFC (Mass): −20.000% |
| SFC (Volume): 0.070 ml fuel/hp-s | Delta SFC (Vol): −17.080% |
| Adjusted SFC: 0.053 g(comb) fuel/hp-s | Efficiency: 0.95 |

Cost:
Cost Breakdown by Component

| component | cost($/eq gallon) |
|---|---|
| Phillips D-2 | 0.482 |
| TOFA w/45% NH3 | 0.188 |
| n-Pentanol | 0.071 |
| Cost: | 0.741 $/equiv gallon |
| Penelty to Diesel (Raw Mat.): | 0.121 $/gallon |
| Penalty to Diesel (Fuel Cons.): | 0.106 $-MPG |
| Penalty to Diesel (Total): | 0.227 |

Pressure Data

| Pressure (psi) | Crank Angle (deg) | |
|---|---|---|
| comp: 625.39 psi | comp: 360.75 | |
| ignition: 592.94 psi | Ignition: 367.76 | |
| max: 727.08 psi | max: 376.28 | |
| ignition delay: −32.45 | ignition delay: 7.01 deg; | 425.39 μs |
| max delay: 101.69 | max delay: 15.53 deg; | 941.94 μs |

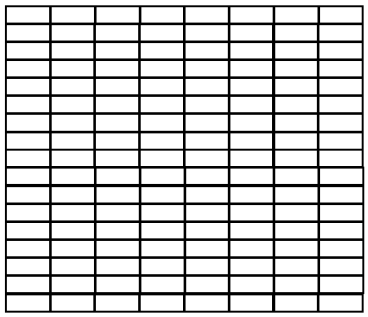

Emissions/Soot
Diesel Reference Runs

| | | | |
|---|---|---|---|
| Diesel CO: | | 567.28 PPM | |
| Diesel NOx: | | 513.16 PPM | |
| Emulsion CO: | 1120 PPM | Delta CO: | 97.43% |
| Emulsion NOx: | 372.11 PPM | Delta NOx: | −27.49% |
| Emulsion NO: | 324.00 PPM | | |
| Emulsion NO2: | 48.00 PPM | | |
| Emulsion CO2: | 7.60% | | |

-continued

APPENDIX A

Raw Data Files

QET Fuel Sample Number: QF-0088-01
Formulation and Composition

| | amnt (grams) | cost ($/lb) | specific grav. | wt % $H_2$ |
|---|---|---|---|---|
| Fuel | | | | |
| Phillips D-2 | 348.5 | 0.0875 | 0.84 | 14.1 |
| | 0 | 0 | 0 | 0.0 |
| Total: | 348.5 | | | |
| Surfactant | | | | |
| TOFA w/45% NH3 | 81 | 0.29 | 0.91 | 14.7 |
| | 0 | 0 | 0 | 0.0 |
| Total: | 81 | | | |
| Water | 30 | 0 | 1.000 | 0.000 |
| Co-Surfactant | | | | |
| n-Pentanol | 40.5 | 0.22 | 0.81 | 13.6 |
| I12-4 Ethoxylate | 12.5 | 1 | 1 | 10.9 |
| Novel II | | | | |
| Total: | 53 | | | |
| Cetane Enhancer | | | | |
| | 0 | 0 | 0 | 0.0 |
| | 0 | 0 | 0 | 0.0 |
| Total: | 0 | | | |
| Total Emulsion: | 512.5 grams | | | 13.27% |

Mixing Notes: KD17-51-1; QF-0056 with Novel II
Fuel Ratios:

wt % Water: 5.85%
wt % Surfactant Package: 26.15%
(Surf + Co-Surf)/Water: 4.47
Surfactant: Co-Surf Ratio: 1.53

Measured Parameters
Heat of Combustion Information for "Fuels"

Emulsion Density (calculated): 0.8620 grams/cc
Emulsion Density (measured): 0.8600 grams/cc DLS Data:

Micelle Size: 1 nm
Intensity (Count Rate): 24.3
Polydispersity: 0.250
Emulsion Viscosity: 7.64 centipoise
Refractive Index: 1.450
Surface Tension: 0 dynes/cm Bomb Data:

Higher Heating Value: 17291.4 Btu/lb
Lower Heating Value: 16080.6 Btu/lb
Combustibility Number: 0.89
Comments: size probably too low to measure - JJD Standard Fuel Consumption

| Diesel Reference Runs | Engine parameters |
|---|---|
| SFC (Mass): 0.059000 g fuel/hp-s | Delta SFC (Mass): −18.000% |
| SFC (Volume): 0.068 ml fuel/hp-s | Delta SFC (Vol): −14.994% |
| Adjusted SFC: 0.053 g(comb) fuel/hp-s | Efficiency: 0.95 |

Cost:
Cost Breakdown by Component

| component | cost($/eq gallon) |
|---|---|
| Phillips D-2 | 0.429 |
| TOFA w/45% NH3 | 0.330 |
| n-Pentanol | 0.125 |

-continued

APPENDIX A

| | |
|---|---|
| I12-4 Ethoxylate Novel II | 0.176 |
| Cost: | 1.060 $/equiv gallon |
| Penelty to Diesel (Raw Mat.): | 0.440 $/gallon |
| Penalty to Diesel (Fuel Cons.): | 0.093 $-MPG |
| Penalty to Diesel (Total): | 0.533 |

Pressure Data

| Pressure (psi) | Crank Angle (deg) | |
|---|---|---|
| comp: 659.90 psi | comp: 359.49 | |
| ignition: 602.86 psi | Ignition: 367.52 | |
| max: 738.94 psi | max: 375.05 | |
| ignition delay: −57.04 | ignition delay: 8.03 deg; | 484.11 μs |
| max delay: 79.04 | max delay: 15.56 deg; | 937.96 μs |

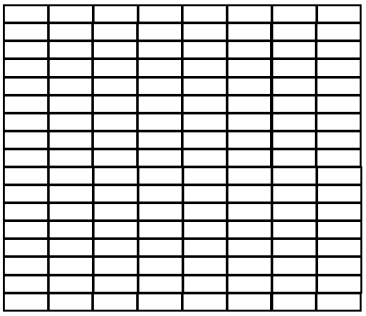

Emissions/Soot
Diesel Reference Runs

| | | | |
|---|---|---|---|
| Diesel CO: | | 538.16 PPM | |
| Diesel NOx: | | 527.50 PPM | |
| Emulsion CO: | 1116.4 PPM | Delta CO: | 107.45% |
| Emulsion NOx: | 398.2 PPM | Delta NOx: | −24.51% |
| Emulsion NO: | 350.80 PPM | | |
| Emulsion NO2: | 47.00 PPM | | |
| Emulsion CO2: | 7.50% | | |

QET Fuel Sample Number: QF-0090-01
Formulation and Composition

| | amnt (grams) | cost ($/lb) | specific grav | wt % $H_2$ |
|---|---|---|---|---|
| Fuel | | | | |
| Phillips D-2 | 360 | 0.0875 | 0.84 | 14.1 |
| | 0 | 0 | 0 | 0.0 |
| Total: | 360 | | | |
| Surfactant | | | | |
| TOFA w/45% MEA | 90 | 0.2972 | 0.91 | 11.7 |
| | 0 | 0 | 0 | 0.0 |
| Total: | 90 | | | |
| Water | 30 | 0 | 1.000 | 0.000 |
| Co-Surfactant | | | | |
| n-Pentanol | 20 | 0.22 | 0.81 | 13.6 |
| I12-4 Ethoxylate | 12.5 | 1 | 1 | 10.9 |
| Novel II | | | | |
| Total: | 32.5 | | | |
| Cetane Enhancer | | | | |
| | 0 | 0 | 0 | 0.0 |
| | 0 | 0 | 0 | 0.0 |
| Total: | 0 | | | |
| Total Emulsion: | 512.5 | | | 12.78% |

-continued

APPENDIX A grams
Mixing Notes: KD17-51-3; QF-0057 & Novel II
Fuel Ratios:

| | |
|---|---|
| wt % Water: | 5.85% |
| wt % Surfactant Package: | 23.90% |
| (Surf + Co-Surf)/Water: | 4.08 |
| Surfactant: Co-Surf Ratio: | 2.77 |

Measured Parameters
Heat of Combustion Information for "Fuels"

| | |
|---|---|
| Emulsion Density (calculated): 0.8644 grams/cc | Emulsion Density (measured): 0.0000 grams/cc |

DLS Data:

| | |
|---|---|
| Micelle Size: 1 nm | Emulsion Viscosity: 8591 centipoise |
| Intensity (Count Rate): 24.3 | Refractive Index: 1.454 |
| Polydispersity: 0.250 | Surface Tension: 0 dynes/cm |

Bomb Data:

| | |
|---|---|
| Higher Heating Value: 17659.5 Btu/lb | Lower Heating Value: 16493.7 Btu/lb |

Combustibility Number: 0.91
Comments: size probably too low to measure with DLS - JJD Standard Fuel Consumption

| Diesel Reference Runs | Engine parameters |
|---|---|
| SFC (Mass): 0.058000 g fuel/hp-s | Delta SFC (Mass): −16.000% |
| SFC (Volume): 0.067 ml fuel/hp-s | Delta SFC (Vol): −12.727% |
| Adjusted SFC: 0.053 g(comb)fuel/hp-s | Efficiency: 0.94 |

Cost:
Cost Breakdown by Component

| component | cost($/eq gallon) |
|---|---|
| Phillips D-2 | 0.444 |
| TOFA w/45% MEA | 0.377 |
| n-Pentanol | 0.062 |
| I12-4 Ethoxylate Novel II | 0.176 |
| Cost: | 1.060 $/equiv gallon |
| Penelty to Diesel (Raw Mat.): | 0.440 $/gallon |
| Penalty to Diesel (Fuel Cons.): | 0.079 $-MPG |
| Penalty to Diesel (Total): | 0.519 |

Pressure Data

| Pressure (psi) | Crank Angle (deg) | |
|---|---|---|
| comp: 657.81 psi | comp: 359.24 | |
| ignition: 615.18 psi | Ignition: 365.76 | |
| max: 769.54 psi | max: 372.77 | |
| ignition delay: −42.62 | ignition delay: 6.51 deg, | 395.66 μs |
| max delay: 111.73 | max delay: 13.53 deg, | 821.75 μs |

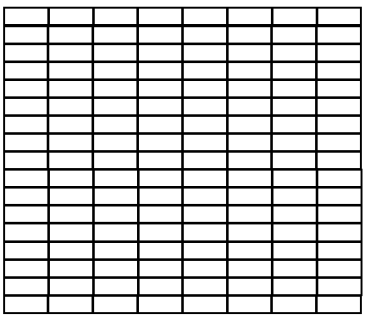

-continued

APPENDIX A

Emissions/Soot
Diesel Reference Runs

| | | | |
|---|---|---|---|
| Diesel CO: | | 523.25 PPM | |
| Diesel NOx: | | 528.65 PPM | |
| Emulsion CO: | 1190 PPM | Delta CO: | 127.42% |
| Emulsion NOx: | 394 PPM | Delta NOx: | −25.47% |
| Emulsion NO: | 348.00 PPM | | |
| Emulsion NO2: | 46.00 PPM | | |
| Emulsion CO2: | 7.50% | | |

We claim:

1. A composition comprising:

fuel;

clusters dispersed within the fuel, the clusters being characterized by having protruding delocalized pπ orbitals.

2. The composition of claim 1, wherein said cluster comprises oxygen-containing molecules capable of successive orbital interactions sufficient to produce delocalized pπ-type orbitals that protrude from the surface of the structure and impart high reactivity to at least one oxygen within that structure.

3. The composition of claim 1, wherein the clusters comprise water clusters characterized in having filled delocalized pπ-type orbitals formed by the successive interaction of $b_1$ and $1b_2$ orbitals on adjacent water molecules, the delocalized pπ-type orbitals protruding from the surface of a water structure and imparting high reactivity to oxygens within that structure.

4. The composition of claim 3, wherein the oxygen-containing molecules are selected from the group consisting of water, saturated alcohols, surfactants, clathrated ions, clathrathed atoms, clathrated molecules, and clathrated complex organic or metallo-organic ligands.

5. The composition of claim 3, wherein the water cluster is characterized by having an electronic structure that allows it to act as catalyst for an oxidative addition reaction.

6. The composition of claim 3, wherein the water cluster is characterized by enhanced oxygen vibrational modes so that the cluster is highly reactive.

7. The composition of claim 3, wherein the water cluster comprises pentagonal structures.

8. The composition of claim 6, wherein the water cluster vibrational modes have been enhanced by application of an external field.

9. The composition of claim 6, wherein enhancing oxygen-oxygen vibrational modes comprises the use of the dynamical Jahn-Teller effect.

10. The composition of claim 1 further comprising a first surfactant characterized by an ability to participate in the delocalized pπ orbitals.

11. The composition of claim 10 wherein the first surfactant has a hydrophilic end that includes at least one oxygen.

12. The composition of claim 11 wherein the hydrophilic end includes at least one chemical group selected from the group consisting of carboxyl (COOH), ethoxyl ($CH_3CH_2O$), $CO_3$ and $NO_3$.

13. The composition of claim 1 wherein the first surfactant has a hydrophobic end comprising a hydrophobic tail containing approximately 6–20 carbon atoms.

14. The composition of claim 1, wherein the first surfactant is selected from the group consisting of oleic acid, linoleic acid and stearic acid.

15. The composition of claim 13 further comprising a second surfactant that is less polar than the first surfactant and participates in ordering the hydrophobic end of the first surfactant.

16. The composition of claim 1 wherein the water clusters have an average diameter of less than about 20 Å.

17. The composition of claim 16 wherein each water cluster comprises between about 5 and 300 water molecules.

18. The composition of claim 17 wherein each water cluster comprises between about 20 and 100 water molecules.

19. The composition of claim 18 wherein each water cluster comprises about 20 water molecules.

20. The composition of claim 1 wherein the water clusters contain arrangements of water molecules having at least partial pentagonal symmetry.

21. The composition of claim 20 wherein the water clusters contain arrangements of water molecules having at least partial pentagonal dodecahedral symmetry.

22. The composition of claim 21 wherein each water cluster comprises at least one pentagonal dodecahedral water cluster.

23. The composition of claim 22 wherein each water cluster comprises about 20 water molecules, arranged as a pentagonal dodecahedron.

24. The composition of claim 1 prepared by a method comprising:

providing the water clusters; and dispersing the water clusters in the fuel.

25. The composition of claim 24 wherein the step of providing comprises inducing oxygen-oxygen vibrational modes having vibrational frequencies in the near infrared to microwave region.

26. The composition of claim 25 wherein the step of providing comprises inducing oxygen-oxygen vibrational modes having vibrational frequencies in the range of about 5 $cm^{-1}$ to 250 $cm^{-1}$.

27. The composition of claim 25 wherein the step of inducing comprises applying an external field.

28. The composition of claim 25 wherein the step of inducing comprises inducing the oxygen-oxygen vibrational modes intrinsically through the dynamical Jahn-Teller effect.

29. The composition of claim 24 wherein the step of providing comprises ejecting water from a hypersonic nozzle so that pentagonal dodecahedral water structures are produced.

30. The composition of claim 29, wherein the step of ejecting comprises ejecting water from a hypersonic nozzle that comprises a catalytic material.

31. The composition of claim 30 wherein the catalytic material is selected from the group consisting of nickel and nickel alloys.

32. The composition of claim 1 wherein the step of providing comprises providing pentagonal dodecahedral water clusters.

33. The composition of claim 32 wherein the step of providing pentagonal dodecahedral water clusters comprises a method selected from the group consisting of clathration, addition of a surfactant, application of an electric spark of sufficient voltage and appropriate frequency, and application of ultrasonic waves.

34. The composition of claim 24, claim 29 or claim 30, wherein the step of providing comprises steps of:

providing neutral clusters; and ionizing the neutral clusters.

35. The composition of claim 1 or wherein the emulsion contains at least about 5% water.

36. The composition of claim 1 wherein the emulsion contains between 5 and 12% water.

37. The composition of claim 1 wherein the fuel comprises a hydrocarbon.

38. The composition of claim 1 wherein the fuel comprises gasoline or diesel.

39. The composition of claim 1 wherein the fuel comprises diesel.

40. The composition of claim 1 wherein combustion of the emulsion in a standard diesel engine produces reduced particulate $NO_x$ emissions as compared with combustion of pure diesel fuel in the engine.

41. The composition of claim 1 further comprising an additive selected to improve a characteristic selected from the group consisting of stability, combustibility, and lubricity.

42. The composition of claim 1 further comprising a neutralizing agent.

43. The composition of claim 42 wherein the neutralizing agent is selected from the group consisting of methyl amine and ammonia.

44. The composition of claim 40, wherein the reduction in particulate $NO_x$ emissions is in the range of 20–30%.

45. A method of increasing efficiency of fuel combustion, the method comprising steps of:

providing water clusters characterized by having protruding delocalized $p\pi$ orbitals; and exposing the water clusters to fuel in a manner that allows overlap between the protruding $p\pi$ water cluster orbitals and orbitals associated with fuel carbons.

* * * * *